US005878304A

United States Patent [19]

Watanabe et al.

[11] Patent Number: 5,878,304

[45] Date of Patent: Mar. 2, 1999

[54] PROCESS CARTRIDGE HAVING SHIFTABLE COVER WITH INNER PROTRUSION

[75] Inventors: Kazushi Watanabe, Yokohama; Tadayuki Tsuda, Kawasaki; Hiroyuki Shirai, Tokyo; Teruo Komatsu; Ikuo Ikemori, both of Yokohama, all of Japan

[73] Assignee: Canon Kabushiki Kaisha, Tokyo, Japan

[21] Appl. No.: 372,842

[22] Filed: Jan. 13, 1995

Related U.S. Application Data

[63] Continuation of Ser. No. 861,370, Mar. 31, 1992, abandoned.

[30] Foreign Application Priority Data

Dec. 20, 1991 [JP] Japan ..... 3-338597
Mar. 12, 1992 [JP] Japan ..... 4-053695

[51] Int. Cl.[6] ..... G03G 21/20

[52] U.S. Cl. ..... 399/92; 399/114

[58] Field of Search ..... 355/200, 210, 355/211, 215; 399/92, 111, 114

[56] References Cited

U.S. PATENT DOCUMENTS

| | | | |
|---|---|---|---|
| 3,985,436 | 10/1976 | Tanaka et al. | 355/200 |
| 4,462,677 | 7/1984 | Nomura et al. | 355/210 |
| 4,470,689 | 9/1984 | Onoda | 355/211 |
| 4,540,268 | 9/1985 | Toyono et al. | 355/210 |
| 4,708,455 | 11/1987 | Kubota et al. | 355/211 |
| 4,829,334 | 5/1989 | Takamatsu et al. | 355/211 X |
| 4,875,077 | 10/1989 | Takamatsu et al. | 355/212 |
| 4,941,015 | 7/1990 | Komai et al. | 355/200 |
| 5,083,158 | 1/1992 | Kashima et al. | 355/200 |
| 5,113,220 | 5/1992 | Kwak | 355/200 |

FOREIGN PATENT DOCUMENTS

| | | | |
|---|---|---|---|
| 3220538 | 12/1982 | Germany . | |
| 0058446 | 4/1984 | Japan | 355/211 |
| 59-061865 | 4/1984 | Japan . | |
| 59-165072 | 9/1984 | Japan . | |
| 0114872 | 6/1985 | Japan | 355/211 |
| 0244472 | 9/1989 | Japan | 355/211 |
| 2-11158 | 3/1990 | Japan . | |
| 2101933 | 1/1983 | United Kingdom . | |

*Primary Examiner*—Robert Beatty
*Attorney, Agent, or Firm*—Fitzpatrick, Cella, Harper & Scinto

[57] ABSTRACT

A process cartridge detachably mountable within an image forming system, includes an image bearing member, a processing device for acting on the image bearing member, a housing for supporting the image bearing member and the processing device, and a cover shiftable between a closed position where the image bearing member is protected and an open position where the cover is retracted from the protecting position. The cover is spaced apart from the housing at least in the retracted position and is provided with a protruded portion at its inner surface. An image forming system includes a mounting device for mounting a process cartridge, an air flow generating device for generating an air flow passing between the protruded portion and the cover, a transfer device for transferring a developed image formed on the image bearing member onto a recording medium, and a conveying device for conveying a recording medium.

26 Claims, 25 Drawing Sheets

PROCESS CARTRIDGE HAVING SHIFTABLE COVER WITH INNER PROTRUSION

This application is a continuation of prior application Ser. No. 07/861,370 filed on Mar. 31, 1992, now abandoned.

BACKGROUND OF THE INVENTION

1. Field of the Invention

The present invention relates to a process cartridge and an image forming system within which such a process cartridge can be mounted. The image forming system may be an electrophotographic copying machine, a laser beam printer (LBP), a facsimile system, a word processor or the like.

2. Related Background Art

In the past, an image forming system having a removable process cartridge including a desired process means necessary for forming an image, which thereby permits easy replacement of the cartridge due to the expiration of the service life of the cartridge or the like has been proposed (refer to U.S. Pat. No. 3,985,436). Further, a plurality of process cartridges having developer of different colors therein can be used to form a color image, and thus, have a high frequency of exchange, and in some cases, the process cartridge alone is disposed outside the image forming system. Under those circumstances, it is necessary to prevent a photosensitive member from being smudged or damaged and to prevent the photosensitive member from being exposed to light (which leads to the deterioration of the photosensitive member). To this end, the process cartridge is provided with a cover member for protecting the photosensitive member and shielding the interior of the cartridge from ambient light.

The present inventors invented particularly effective techniques in this technical field and disclosed them in U.S. Pat. Nos. 4,470,689 and 4,462,677 and in the Japanese Patent Publication No. 2-11158 (published on Mar. 13, 1990).

The present invention relates to an improvement in the above-mentioned techniques.

SUMMARY OF THE INVENTION

An object of the present invention is to provide a process cartridge and an image forming system which can further enhance image quality.

Another object of the present invention is to provide a process cartridge and an image forming system which can be protected from a bad influence of heat.

A further object of the present invention is to provide a process cartridge and an image forming system which can discharge heat effectively.

A still further object of the present invention is to provide a process cartridge and an image forming system wherein a protection member for protecting an image bearing member from light and (or) smudge forms a part of a fluid passage.

A further object of the present invention is to provide a process cartridge and an image forming system which can prevent the deterioration of features of an image bearing member due to heat.

A still further object of the present invention is to provide a process cartridge and an image forming system wherein, when the process cartridge is mounted within the image forming system, a protection member for covering an opening of the process cartridge in its dismounted condition is retarded from the opening completely to be positioned and spaced apart from a frame of the process cartridge.

A further object of the present invention is to provide a process cartridge which comprises an image bearing member, an action member acting on the image bearing member, a frame for supporting the image bearing member and the action member, and a protection member shiftable between a covering position where it covers a surface of the image bearing member and a retard position where it is retarded up to a lateral end of the frame, and an image forming system within which such process cartridge can be mounted.

Another object of the present invention is to provide an image forming system which can prevent the inadvertent closing movement of a protection member by providing a positioning member for positioning the protection member at its open position.

DETAILED DESCRIPTION OF THE PREFERRED EMBODIMENTS

The present invention will now be explained in connection with embodiments thereof with reference to the accompanying drawings.

Incidentally, in the following embodiment, an image forming system is illustrated as an electrophotographic copying machine, as an example.

Figure 1:
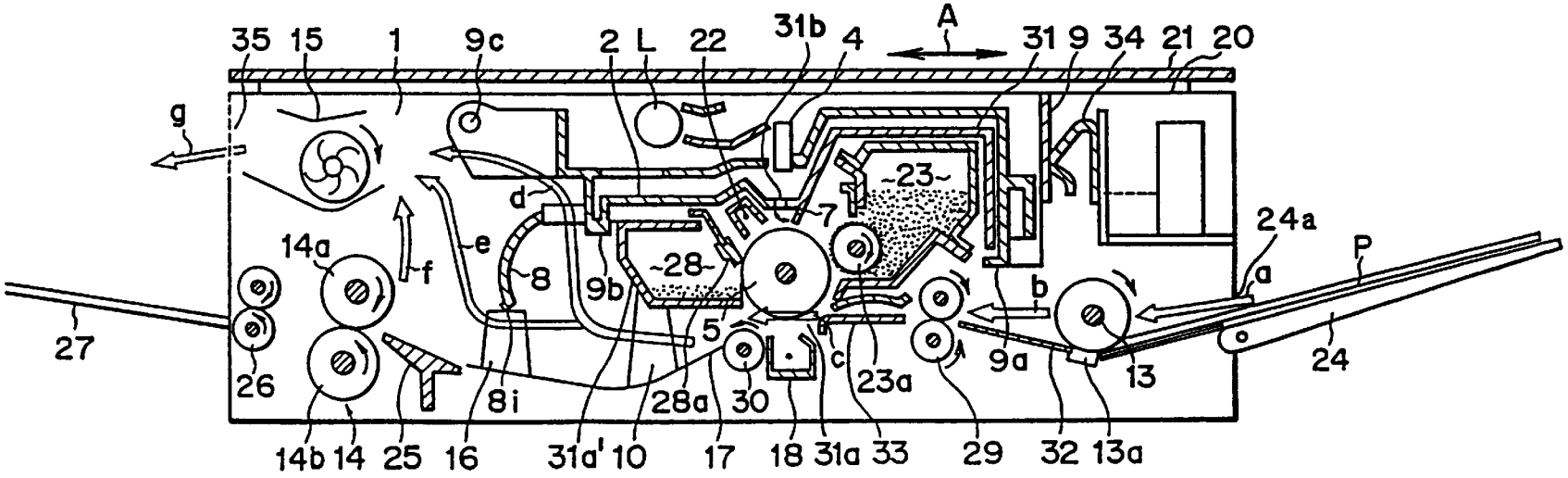
FIGS. 1 to 4 are elevational sectional views of an electrophotographic copying machine to which a preferred embodiment of the present invention is applied.
Figure 2:
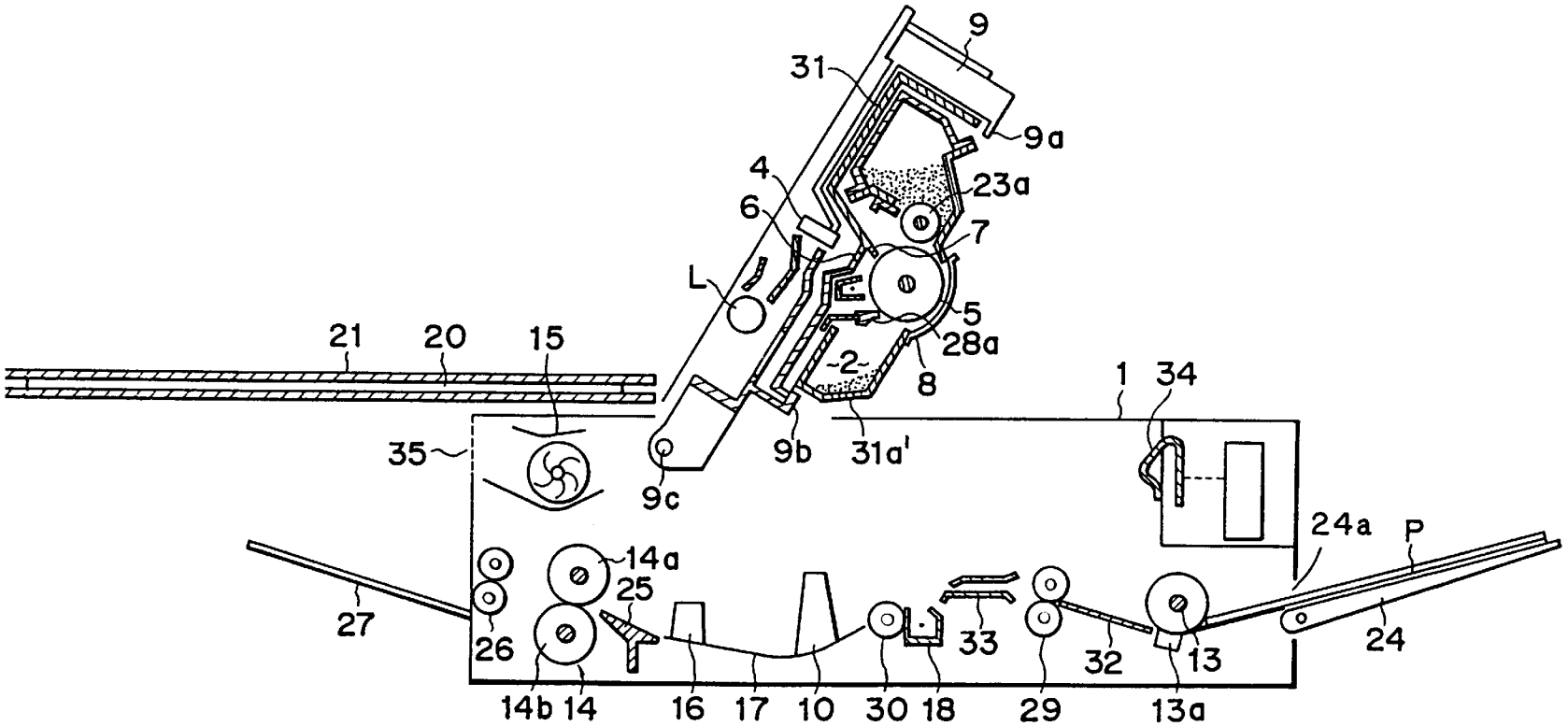

FIG. 1 is an elevational sectional view of the electrophotographic copying machine 1 within which a process cartridge 2 is mounted, in an operative condition. FIG. 2 is an elevational sectional view of the copying machine 1 showing a condition that it is opened. As shown in FIG. 2, the copying machine according to this embodiment includes an upper frame 9 pivotally mounted, via a pins 9*c,* on a body frame of the machine 1. When the process cartridge 2 is desired to be mounted within the copying machine 1, after an original support glass plate 20 and an original cover 21 (which will be described later) are manually retarded leftwardly, the upper frame 9 is opened, and the process cartridge 2 is mounted on the upper frame 9 by locking the former to guides 9*a,* 9*b* of the latter. Thereafter, the upper frame 9 is closed, and the original support glass plate 20 and the original cover 21 are returned to a predetermined original position. Incidentally, a leaf spring 34 is fixed to the body frame of the machine 1. Thus, when the upper frame 9 is closed, it is locked by the leaf spring 34. Further, the upper frame 9 carries a lamp L for illuminating a surface of an original and a lens 4 for directing a light image reflected from the surface of the original to an electrophotographic photosensitive member 5, which elements L, 4 act as optical members for exposing the original.

Now, the electrophotographic copying machine to which this embodiment is applied will be explained.

The reference numeral 20 denotes the above-mentioned original support glass plate on which an original can be rested and which can be reciprocally moved in directions shown by the arrow A. The reference numeral 21 denotes the above-mentioned original cover. The original rested on the original support glass plate 20 is illuminated by the lamp L, and a light image reflected from the surface of the original is directed to the electrophotographic photosensitive member 5 via the lens 4. When the light image is illuminated on the photosensitive member 5 previously charged by a charger 22, a latent image is formed on the photosensitive member. Then, the latent image is developed by a developing device 23 having a developing sleeve 23*a* for feeding toner to the photosensitive member 5 to develop the latent image. The developed image is then transferred, by a transfer charger 18, onto a recording medium P such as a recording sheet fed from a manual sheet supply plate 24 by a sheet supply roller 13 and sent to the photosensitive member 5 in registration with the developed image by a pair of regist rollers 29 and a guide 33. Incidentally, an urging pad 13*a* cooperates with the sheet supply roller 13 to separate the recording media P one by one. Then, the recording medium P is guided by guides 17, 25, 33 to reach a fixing device, 14 (including a heat roller 14*a* and a pressure roller 14*b*), where the developed image is fixed to the recording medium. After the fixing operation, the recording medium is ejected onto a tray 27 by ejector rollers 26. On the other hand, after the developed image is transferred, a surface of the photosensitive member 5 is cleaned by a cleaning device 28 having a cleaning blade 28*a* for removing the residual toner from the photosensitive member 5. Incidentally, the reference numeral 15 denotes a fan (for example, cross flow fan) for generating air flows a–g; 30 denotes a convey roller; and 35 denotes an air outlet.

Figure 3:
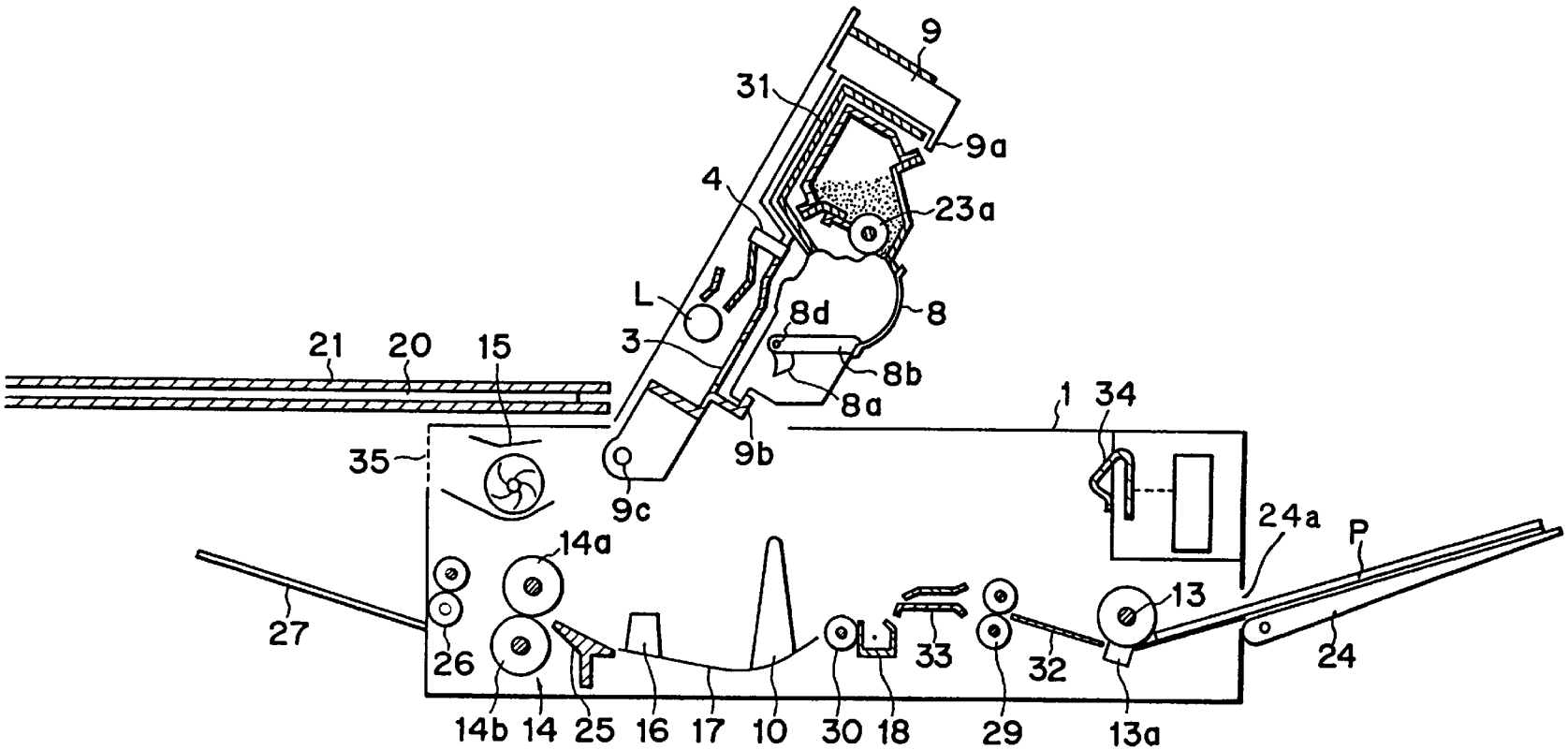
Figure 4:
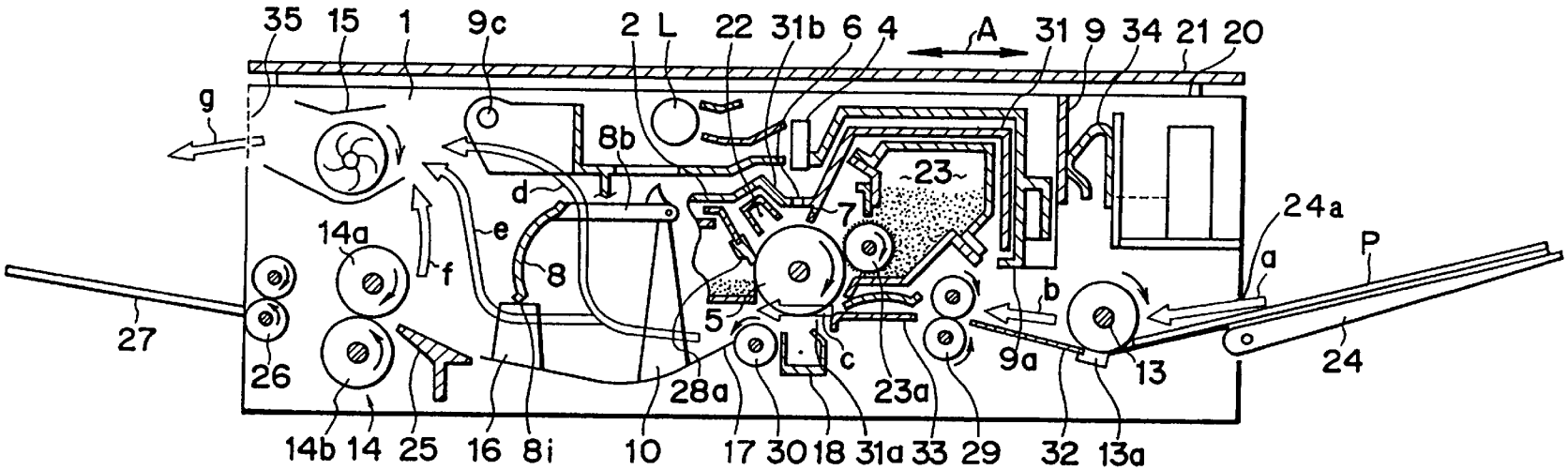
Figure 5:
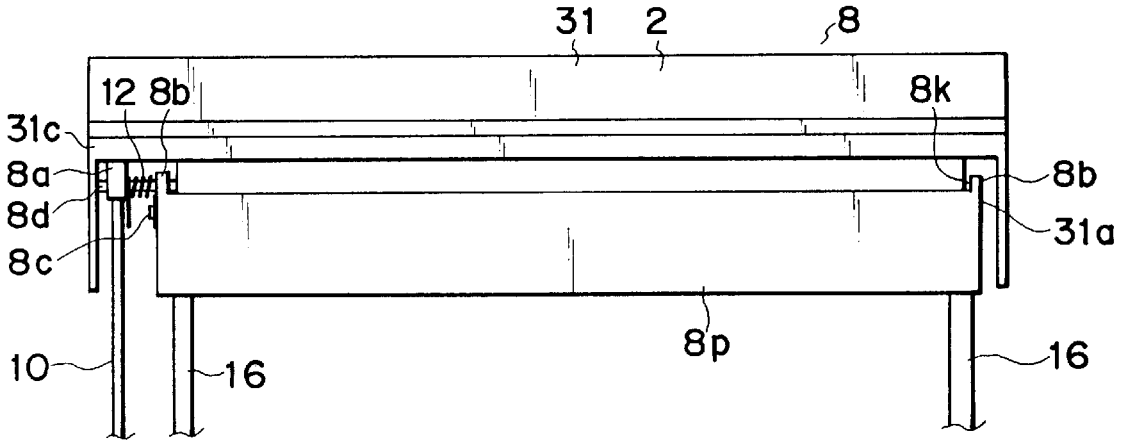
FIG. 5 is an elevational view showing a relation between a cover of a process cartridge and the copying machine.
Figure 6A:
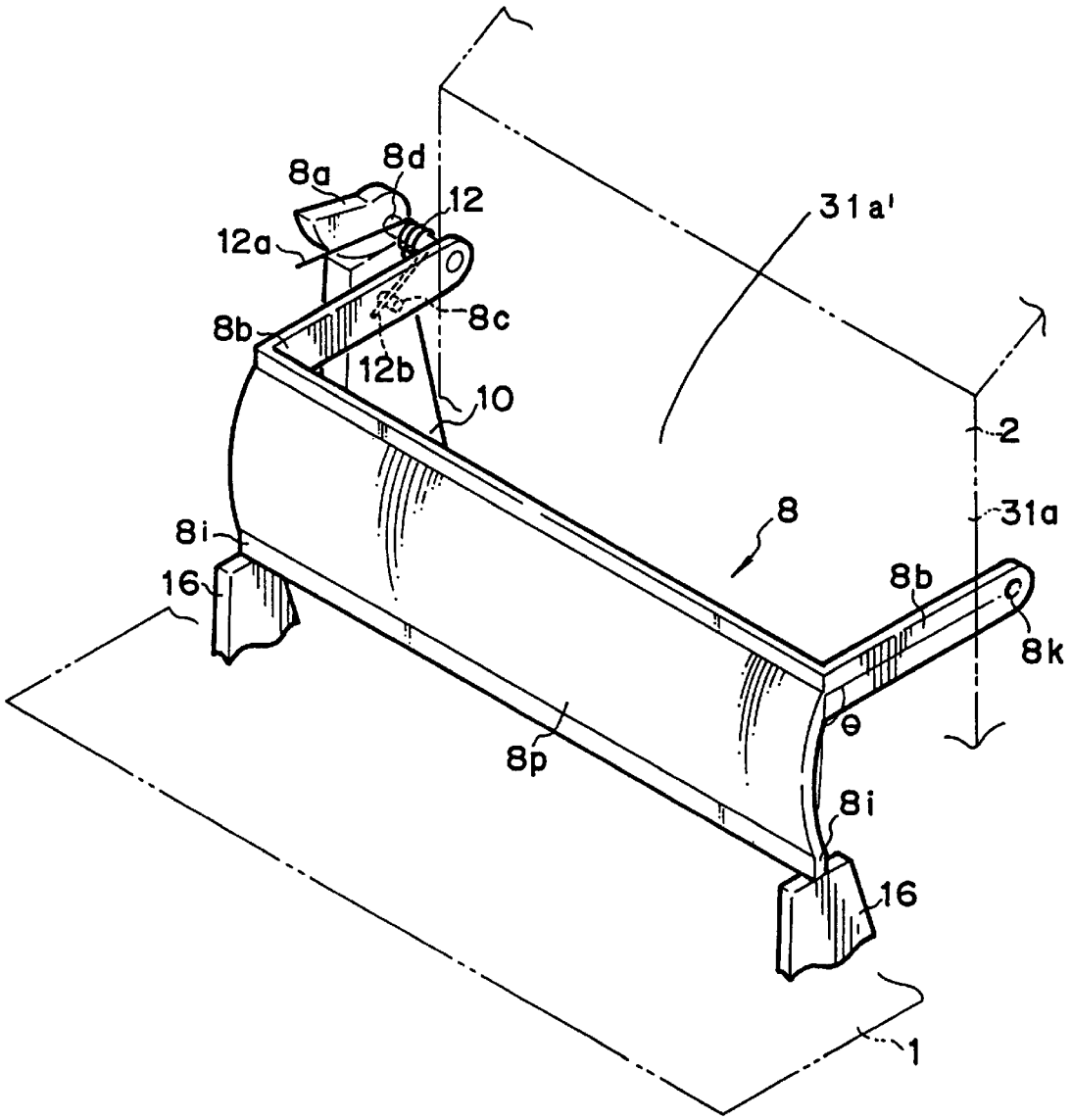
FIGS. 6A and 6B are perspective views showing the relation between the cover of the process cartridge and the copying machine.
Figure 6B:
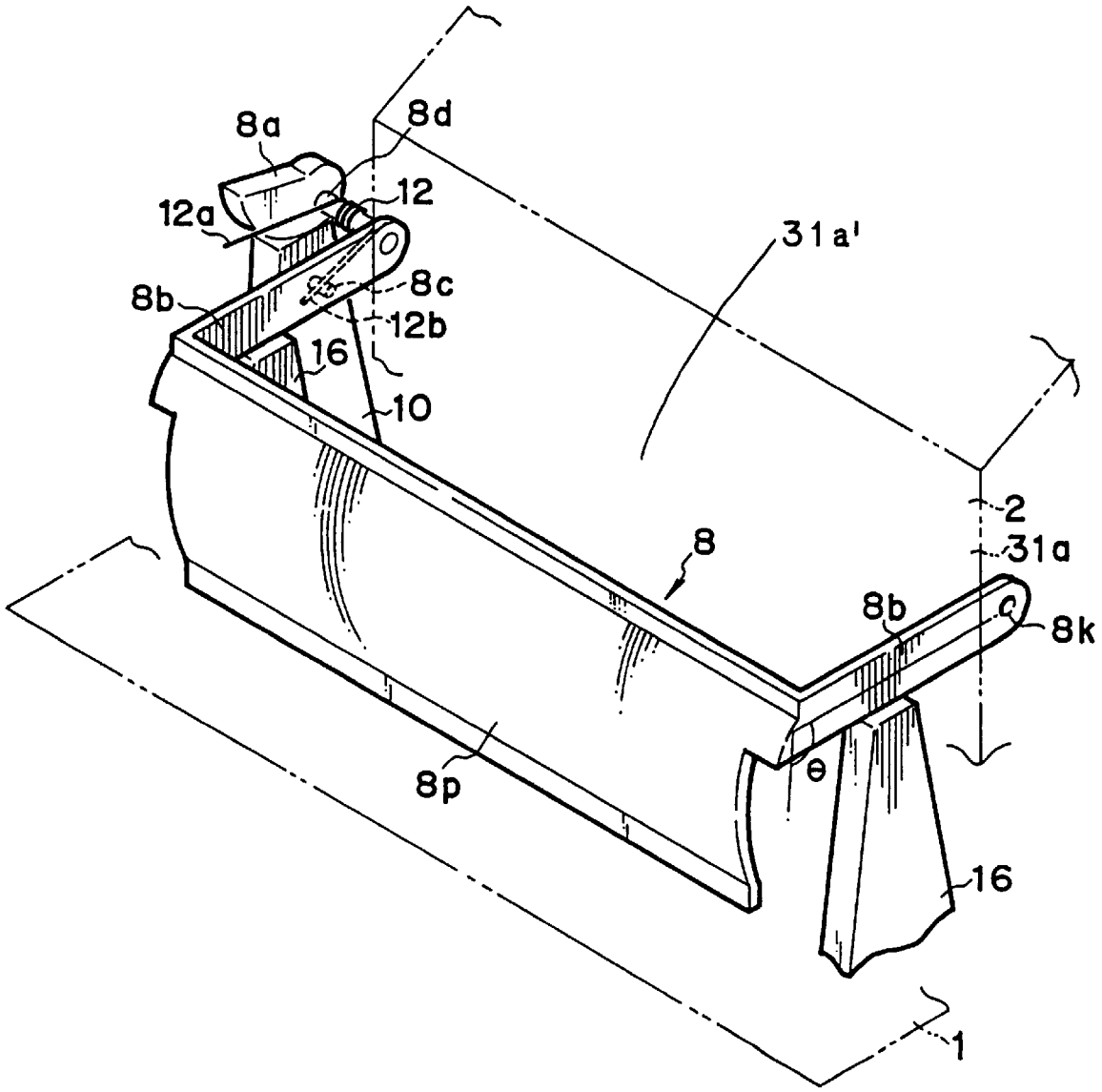

Next, an embodiment of a process cartridge to which the present invention is applied will be explained with reference to FIGS. 1 to 6. Incidentally, FIG. 3 is an elevational sectional view showing a condition that the upper frame 9 is opened with respect to the body frame of the copying machine, FIG. 4 is an elevational sectional view showing a condition that the upper frame 9 is closed with respect to the body frame of the copying machine, FIG. 5 is a side view of a cover 8 of the process cartridge 2, and FIGS. 6A and 6B are perspective views of the cover. The cover 8 and a frame 31 of the process cartridge 2 is formed from HIPS resin (high impact polystyrol resin) of high impact type among polystyrene resin materials. The material of the process cartridge is not limited to the above resin, but may be fast resin such as polyphenyleneoxide (PPO).

The process cartridge according to this embodiment has a frame 31 integrally supporting therein a photosensitive drum 5, a developing device 23, a cleaning device 28 and a charger 22 (these elements 23, 28, 22 serving as action means for acting on the photosensitive drum 5). The frame 31 of the cartridge can be removably mounted on the upper frame 9 of the copying machine 1. The frame 31 is designed so that a transfer area 31*a* and an image exposure area 31*b* of the photosensitive drum 5 are exposed, and covers 8, 7 for protecting these areas are provided for opening/closing movements. Incidentally, an opening/closing mechanism 6 for the cover 7 for the exposure area 31*b* may be any one of conventional mechanisms, and, thus, the explanation thereof will be omitted.

Next, an opening/closing mechanism for the cover 8 for protecting the transfer area 31*a* of the photosensitive drum 5 will be explained.

The cover 8 has a cover portion 8*p,* and arm portions 8*b* integrally formed with the cover portion 8*p* and extending therefrom at an angle of θ of 120–130 degrees (FIG. 6). The cover portion 8*p* is so curved and shaped that, when the cover is closed, the cover portion is conformed to a peripheral surface of the photosensitive drum 5. Further, the arms 8*b* are pivotally mounted on pins 8*d,* 8*k* formed on side walls 31*c* of the frame 31 of the cartridge 2, and a torsion coil spring 12 is arranged on the pin 8*d* so that it biases the cover portion 8*p* toward its closed position. One end 12*a* of the torsion coil spring 12 is locked to the frame 31 of the cartridge, and the other end 12*b* of the spring is engaged by a projection 8*c* formed on the arm 8*b*. Further, a cam 8*a* is fixedly mounted on one end of the pin 8*d* so that the cam is rotated together with the arm 8*b*.

Now, the opening/closing movement of the cover 8 will be explained.

When the process cartridge 2 is in a condition that it is detached from the copying machine 1, the cover 8 is so positioned, by the torsion coil spring 12, that the cover portion 8*p* covers the surface of the photosensitive drum 5.

However, when the cartridge 2 is mounted on the guides 9*a*, 9*b* of the upper frame 9 of the copying machine 1 (FIGS. 2 and 3) and the upper frame 9 is closed, during the closing movement of the upper frame, a lower surface of the cam 8*a* is abutted against a protrusion 10 fixedly formed on the copying machine 1, thus being rotated in a clockwise direction. As a result, the arms 8*b* are also rotated in the clockwise direction, thereby opening the cover to expose the transfer area 31*a* of the photosensitive drum 5. In the condition that the cover portion 8*p* is completely opened, the cover portion 8*p* is retarded from the transfer area 31*a* and is shifted up to a position corresponding to an end portion 31*a*' of the frame 31 of the cartridge 2 to be spaced apart from the frame 31 (FIGS. 1, 4, 5 and 6). In this point, a free end 8*i* of the cover portion 8*p* is abutted against positioned protrusions 16 fixedly formed on the copying machine 1. Thus, the cover 8 is prevented from inadvertently moving to block a feeding path for the recording medium.

Figure 7:
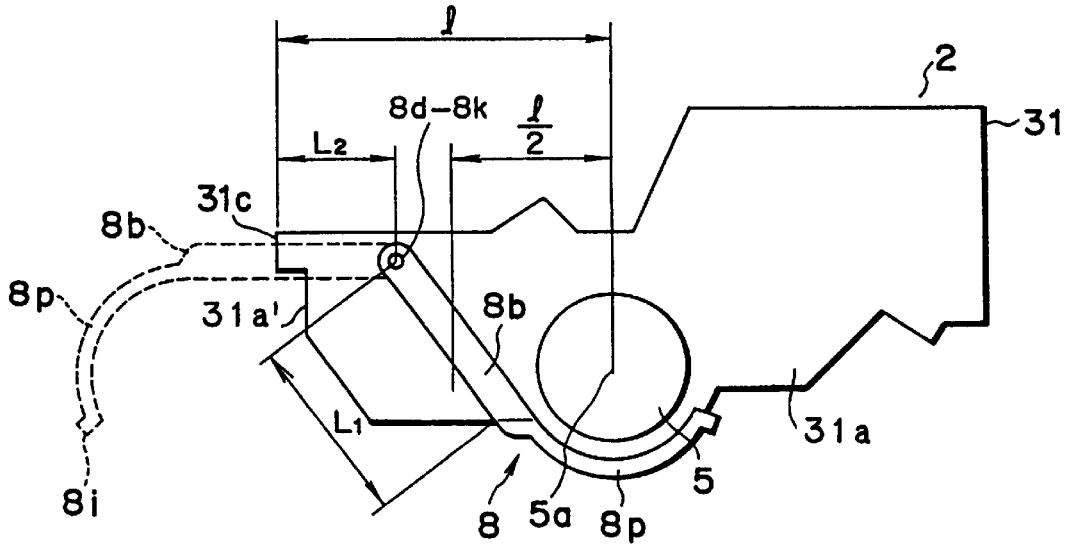
FIG. 7 is an elevational view showing the arrangement of the cover of the process cartridge.

FIG. 7 schematically shows the dimension of the cover 8 of the process cartridge 2.

In the above-mentioned embodiment, a distance $L_1$ between the pivot pins 8*d*, 8*k* for the arms 8*b* and an edge of the cover portion 8*p* nearest to the pivot pins is longer than a distance $L_2$ between the pivot pins 8*d*, 8*k* and the end surface of the cartridge ($L_1>L_2$). Thus, in the condition that the cover portion 8*p* is opened, it is possible to space the cover portion 8*p* apart from the frame 31 of the cartridge. Furthermore, the pivot pins 8*d*, 8*k* for the arms 8*b* are offset toward the end surface of the cartridge from a central point of a half (l/2) of a distance l between a center 5*a* of the drum 5 and the end surface of the cartridge ($(l-L_2)>½$). Thus, it is possible to make the cartridge thinner (more compact), and to space the cover portion 8*p* apart from the frame 31 of the cartridge when the cover portion 8*p* is opened.

Next, the operation of the cover 8 will be explained.

As mentioned above, the process cartridge 2 has the cover 8 for protecting the photosensitive member 5. When the upper frame 9 is opened with respect to the body frame of the copying machine 1, as shown in FIG. 3, the cover 8 pivotally mounted on the frame 31 of the process cartridge 2 via the pins 8*d*, 8*k* is biased toward the anti-clockwise direction by means of the torsion coil spring 12 having one end 12*a* fixed to a portion of the process cartridge 2 and the other end 12*b* engaged by the projection 8*c* of the arm 8*b* of the cover 8 so that the cover 8 covers the photosensitive member 5. When the upper frame 9 is closed with respect to the body frame of the copying machine 1, as shown in FIGS. 4 to 6, the cam 8*a* secured to the pin 8*d* for the arm 8*b* of the cover 8 is rotated in the clockwise direction by the protrusion 10 secured to the copying machine 1. Consequently, the cover 8 is rotated toward its open position. Thus, the process cartridge 2 is mounted within the copying machine 2 with exposing the photosensitive member 5, thereby bringing the copying machine to the operative condition. In this point, the cover 8 has been completely retarded from the lower portion of the process cartridge 2 and positioned near one end surface of the cartridge between the process cartridge 2 and the fixing device 14 and spaced apart from the process cartridge 2. The cover 8 faces a housing of the developing device 28. Further, the free end 8*i* of the cover portion 8*p* is abutted against and properly positioned by the protrusions 16 uprightly protruded from a bottom of the body frame of the copying machine 1 on both outsides of (and perpendicular to) the sheet feeding path (FIG. 6A). Incidentally, in the embodiment shown in FIG. 6A, while an example that the abutment protrusions 16 support the free end 8*i* of the cover portion 8*p* was explained, the present invention is not limited to this example, but, the arms 8*b* may be supported by the protrusions 16, as shown in FIG. 6B.

Next, a further embodiment of the present invention will be explained.

Figure 8:
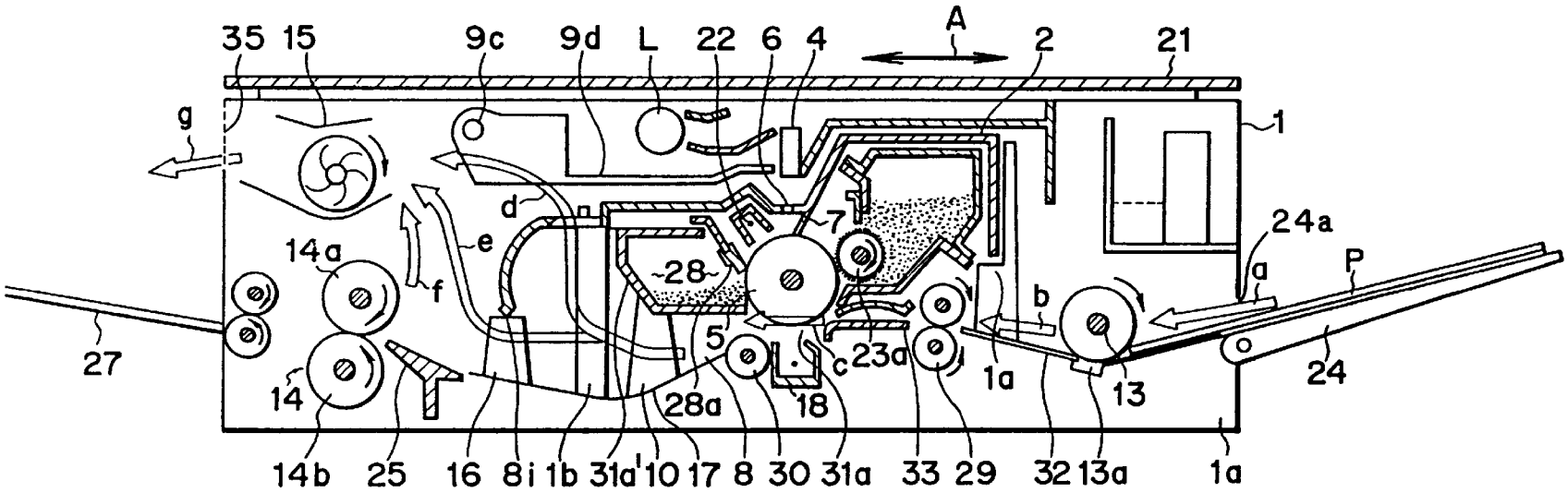
FIG. 8 is an elevational sectional view of an electrophotographic copying machine to which another embodiment of the present invention is applied.
Figure 9:
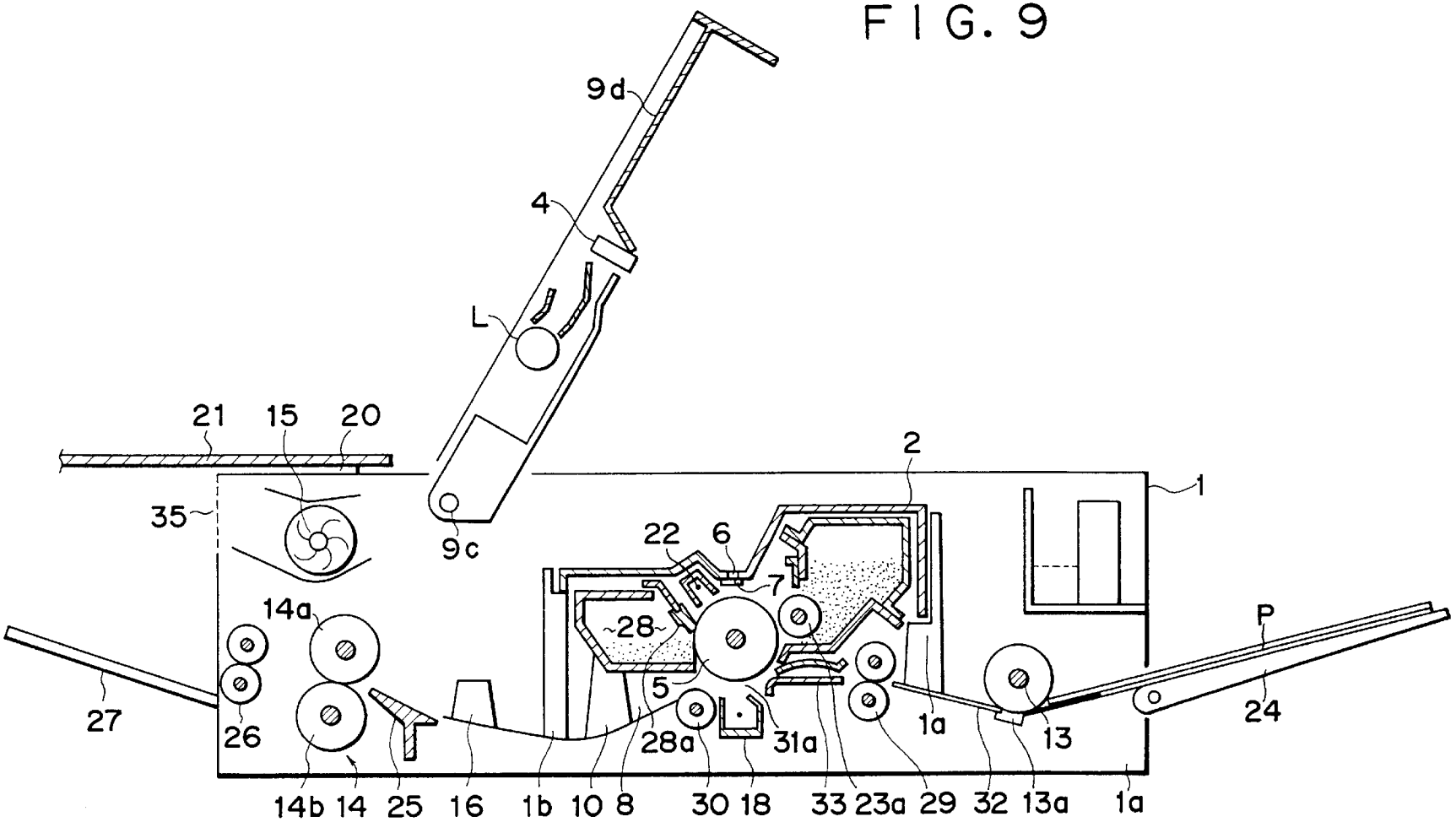
FIG. 9 is an elevational sectional view of an electrophotographic copying machine to which a further embodiment of the present invention is applied.

In the above-mentioned embodiments, the process cartridge 2 was mounted within the image forming system by mounting the opened upper frame 9 of the image forming system and then by closing the upper frame 9 with respect to the system. However, it should be understood that these embodiments can be carried out in an arrangement (as shown in FIGS. 8 and 9) wherein an optical frame 9*d* for opening and closing the upper opening of the copying machine l merely carries the optical system (lamp L and lens 4) (and is not provided with the guides 9*a*, 9*b*) and the process cartridge 2 is mounted on a lower frame la of the copying machine 1 after the optical frame 9*d* is opened.

Now, in the above-mentioned embodiments, when the process cartridge 2 is mounted within the copying machine, the cover portion 8*p* can be retarded from the opening of the process cartridge 2 and be positioned between the process cartridge 2 and the fixing device 14 with spacing apart from the process cartridge (Incidentally, the space or distance between the frame of the process cartridge and the cover member may be about 20 mm–50 mm in these embodiments). Further, in the condition that the cover portion 8*p* is opened, a part of the cover portion 8*p* can be positioned in the copying machine 1. Thus, according to the above-mentioned embodiments, the air flows (a–g) generated by the heat discharging fan 15 are also generated between the cover portion 8*p* and the process cartridge 2, thereby remarkably enhancing the cooling ability for the process cartridge 2 and the cover portion 8*p*, with the result that it is possible to prevent the thermal deformation of the various elements and the melting of the toner in the process cartridge. Further, since the cover portion 8*p* is held in the open position after the cartridge is mounted within the copying machine, the sheet feeding path is not restricted or blocked by the cover, with the result that it is possible to prevent the poor feeding of the recording medium P due to the contacting between the recording medium P and the cover portion 8*p*, and the distortion of the toner image on the recording medium. Furthermore, it is possible to make the image forming system small-sized and to reduce capacity of the heat discharging fan.

Now, air flow paths will be fully explained.

In the illustrated embodiments, the fan 15 is positioned within the copying machine 1 at an upper portion thereof opposite to the position where the manual sheet supply plate 24 is disposed. The fan 15 starts to be driven, for example, upon depressing a copy button (not shown) to generate the air flows. Main air flows are designated by the arrows a–g. When the fan 15 is rotated, the ambient air is introduced into the copying machine 1 mainly through a manual sheet supply opening 24*a* for the manual sheet supply plate 24 (arrow a). The air flow a passes through the sheet supply roller 13 and is directed toward the mounted cartridge 2 along the guide 32 (arrow b). A part of the air flow b impinges against the frame 31 of the cartridge 2 (particularly, the housing of the developing device 23), thereby cooling it. Further, a part of the air flow b enters into a space between the photosensitive member 5 and the transfer charger 18 to reach the cleaning device 28 (arrow c), thus cooling the photosensitive member 5 and the cleaning device 28.

Meanwhile, a part of the air flow enters into the cartridge 2 along the periphery of the photosensitive member 5, thus cooling the cleaning blade 28*a* and the like in the cartridge. A part of the air flow passed through the transfer area 31*a* ascends along the frame 31 to pass between the end surface 31*a*' of the frame 31 and the cover 8, thus reaching the fan (arrow d). In this way, according to the illustrated embodiments, particularly, since the air flow can pass between the end surface 31*a*' of the frame 31 and the cover 8, the air flow does not stagnate in the proximity of the cartridge 2, thus remarkably enhancing the cooling ability for the above-mentioned elements. Further, a part of the air flow passed through the transfer area 31*a* goes straight to impinge against the fixing device 14 and is directed to the fan 15 together with the air flow (arrow f) in the vicinity of the fixing device 14 (arrows e and f). The air flows sucked into the fan 15 are discharged out of the copying machine 1 through the air outlet 35 (arrow g).

In this way, according to the illustrated embodiments, it is possible to suppress the increase in temperature in the interior of the copying machine 1. Particularly, according to the illustrated embodiments, since the air flow can pass between the frame 31 and the cover 8, it is possible to suppress the increase in temperatures in the interior of the cartridge 2 and therearound.

A still further embodiment of the present invention will be explained.

In an embodiment described below, a laser beam printer 100 is used as the image forming system.

Figure 10:
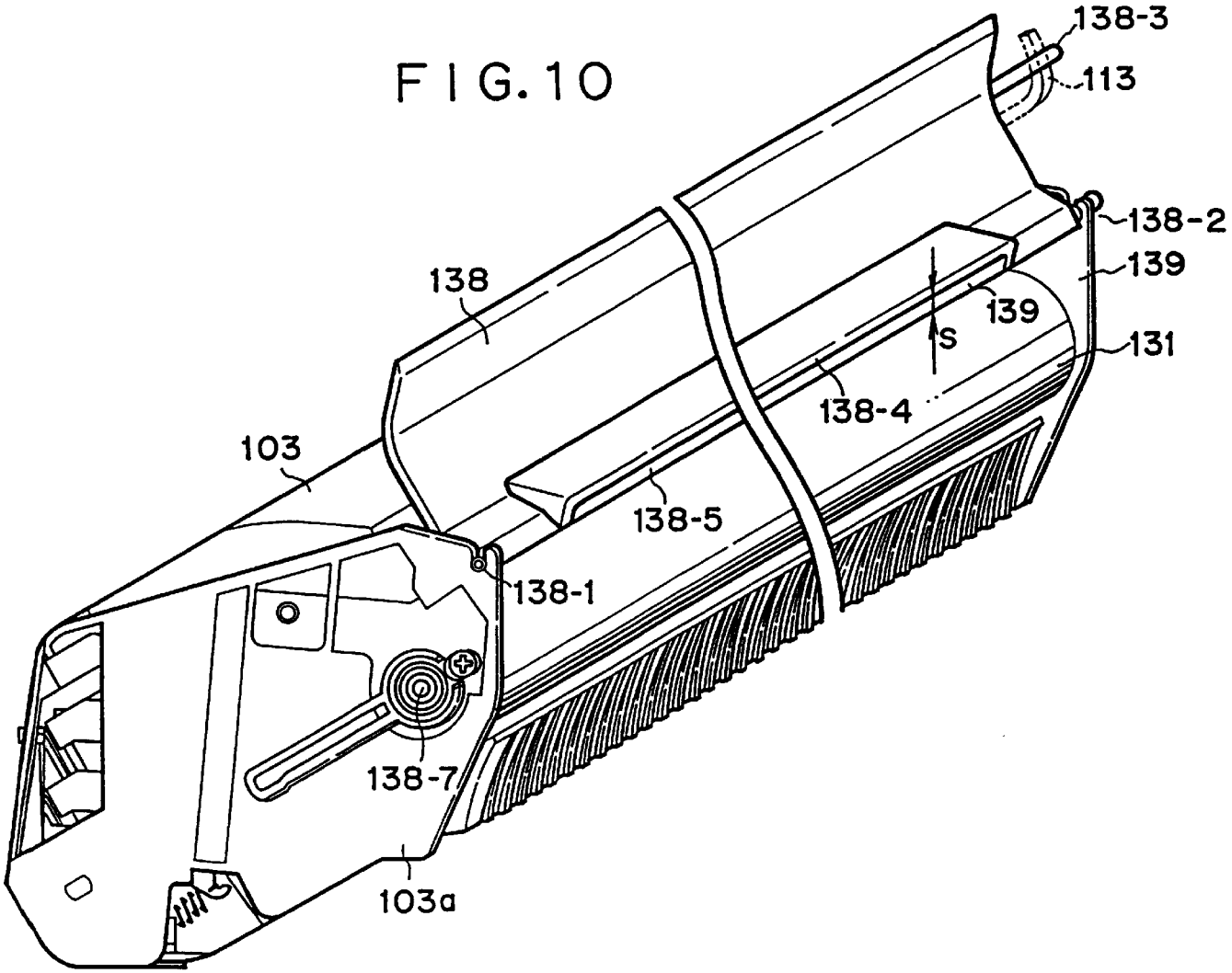
FIG. 10 is a perspective view of a process cartridge to which a further embodiment of the present invention is applied.
Figure 11:
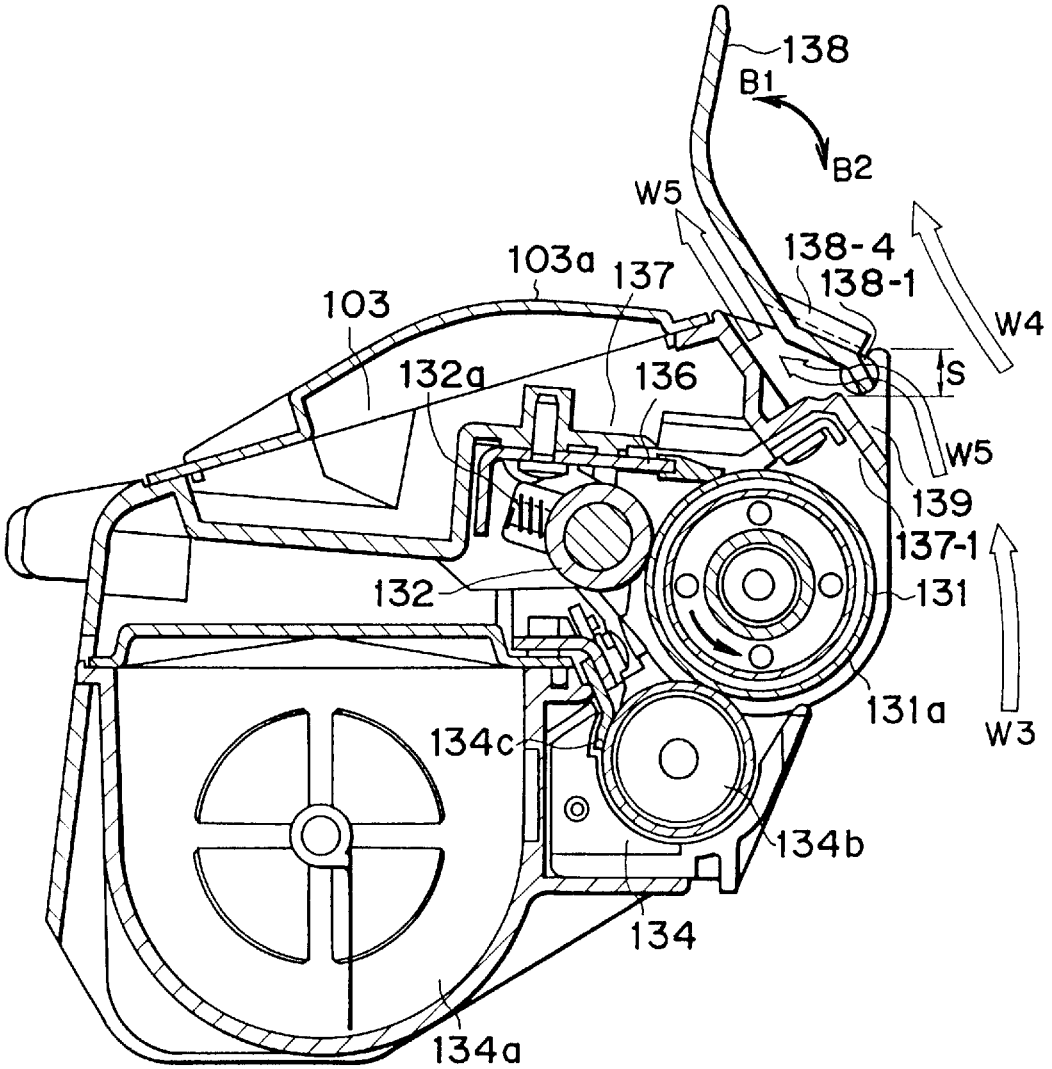
FIG. 11 is a cross-sectional view of the process cartridge of FIG. 10.

First of all, a process cartridge 103 to which the present invention is applied will be explained with reference to FIGS. 10 and 11. Incidentally, FIG. 11 is a cross-sectional view of a process cartridge to which the present invention is applied, and FIG. 10 is a perspective view of such cartridge; these Figures show a condition that the cover is opened. Incidentally, in FIG. 11, air flows are also shown by the arrows. However, it should be noted that these air flows are generated after the cartridge has been mounted within the laser beam printer. According to this embodiment, a drum shutter 138 provided on a process cartridge 103 has a ventilating guide portion so that cool air can be directed to a photosensitive drum 131 and a cleaner member 137. In this way, it is possible to suppress the increase in temperature of the cartridge 103 (particularly, the photosensitive drum 131 and the cleaner member 137 therein).

Now, the process cartridge 103 according to this embodiment will be explained with reference to FIGS. 10 and 11.

In FIGS. 10 and 11, the reference numeral 131 denotes the above-mentioned photosensitive drum rotatable in an counter-clockwise direction. The reference numeral 132 denotes a charger roller for uniformly charging a photosensitive member 131*a* on the surface of the drum. The charger roller 132 is urged against the photosensitive drum 131 by a spring 132*a*. The reference numeral 137 denotes the above-mentioned cleaner member having an elastic cleaning blade 136 urged against the photosensitive member 131*a* and adapted to remove the residual toner remaining on the photosensitive member 131*a*. The reference numeral 134 denotes a developing device having a developing sleeve 134*b* for conveying toner contained in a toner containing portion 134*a* to a peripheral surface of the photosensitive member, and a doctor blade 134*c* for regulating a thickness of a toner layer formed on a peripheral surface of the developing sleeve 134*b*. The reference numeral 138 denotes the above-mentioned drum shutter mounted on a shaft 138-1 arranged above the photosensitive drum 131 for pivotal movement in directions B1 and B2. When the drum shutter is rotated in the direction B1, the photosensitive member 131*a* is exposed, thus permitting the transfer of the image. On the other hand, when the drum shutter is rotated in the direction B2, the photosensitive member is covered by the drum shutter, thus protecting the photosensitive member 131*a*.

The cartridge 103 according to this embodiment has a frame 103*a* supporting the above-mentioned photosensitive drum 131, charger roller 132, developing device 134, developer containing portion 134*a*, cleaner member 137 and drum shutter 138 therein. The frame 103*a* of the cartridge can be mounted within an image forming system 100. Incidentally, in this embodiment, the drum shutter 138 is formed from polycarbonate and the frame 103*a* is formed from high impact styrol to enhance the anti-impact feature, fastness and heat-resistance of them.

Now, the movement of the drum shutter 138 will be explained with reference to FIGS. 10 and 11.

The drum shutter 138 is pivotally mounted on the frame 103*a* of the cartridge at its base end, in a short-side (or width-wise) direction of the drum shutter 138, via pins 138-1, 138-2 so that it can be rocked in directions (shown by the arrows B1, B2) in response to opening/closing movement of a front unit 112 (FIG. 12) provided on the printer 100. More particularly, the printer 100 (FIG. 12) is provided with a lever 113 engaged by a pin 138-3 of the drum shutter 138 and shifted in response to the opening/closing movement of the front unit 112. When the front unit 112 is opened, the lever 113 is lowered, with the result that the drum shutter is closed by a biasing force of a spring and the like (not shown). When the photosensitive drum 131 is exposed (i.e., when the cartridge 103 is in a condition that it is detached from the printer 100 or when the front unit 112 is opened), since the drum shutter 138 is automatically closed to cover the photosensitive drum 131, it is possible to prevent the photosensitive drum 131 from being exposed by the ambient light or being touched by the operator's hand inadvertently. Further, when the operator closes the front unit 112, the pin 138-3 is lifted by the lever 113 to open the drum shutter 138.

In the illustrated embodiment, as shown in FIG. 10, when the drum shutter 138 is opened, a central portion of an inner surface (opposing to the photosensitive drum 131) of the drum shutter 138 is protruded outwardly to create a space or clearance S between a housing 139 of the process cartridge 103 and the shutter. That is to say, a longitudinal protruded member 138-4 having a concave portion is formed on the inner surface of the drum shutter 138 along a long-side (or longitudinal) edge thereof, and a clearance 138-5 (about 2–5 mm in this embodiment) is created between the protruded member 138-4 and the housing 139. In this case, when the drum shutter 138 is closed, since the protruded member is positioned in the vicinity of or abutted against the housing 139 of the cartridge 103, thus further preventing the photosensitive drum 131 from being exposed to the ambient light. Incidentally, the reference numeral 138-7 denotes a rotary support shaft for the photosensitive drum.

Next, the laser beam printer 100 within which the process cartridge 103 can be mounted and which can form an image will be explained with reference to FIGS. 11 and 12.

The laser beam printer to which the present invention is applied comprises a fixing portion disposed directly about a transfer portion and is so designed that it utilizes a process cartridge incorporating various electrophotographic processes therein, thereby making the printer small-sized and reducing the increase in the temperature of the process cartridge.

Figure 12:
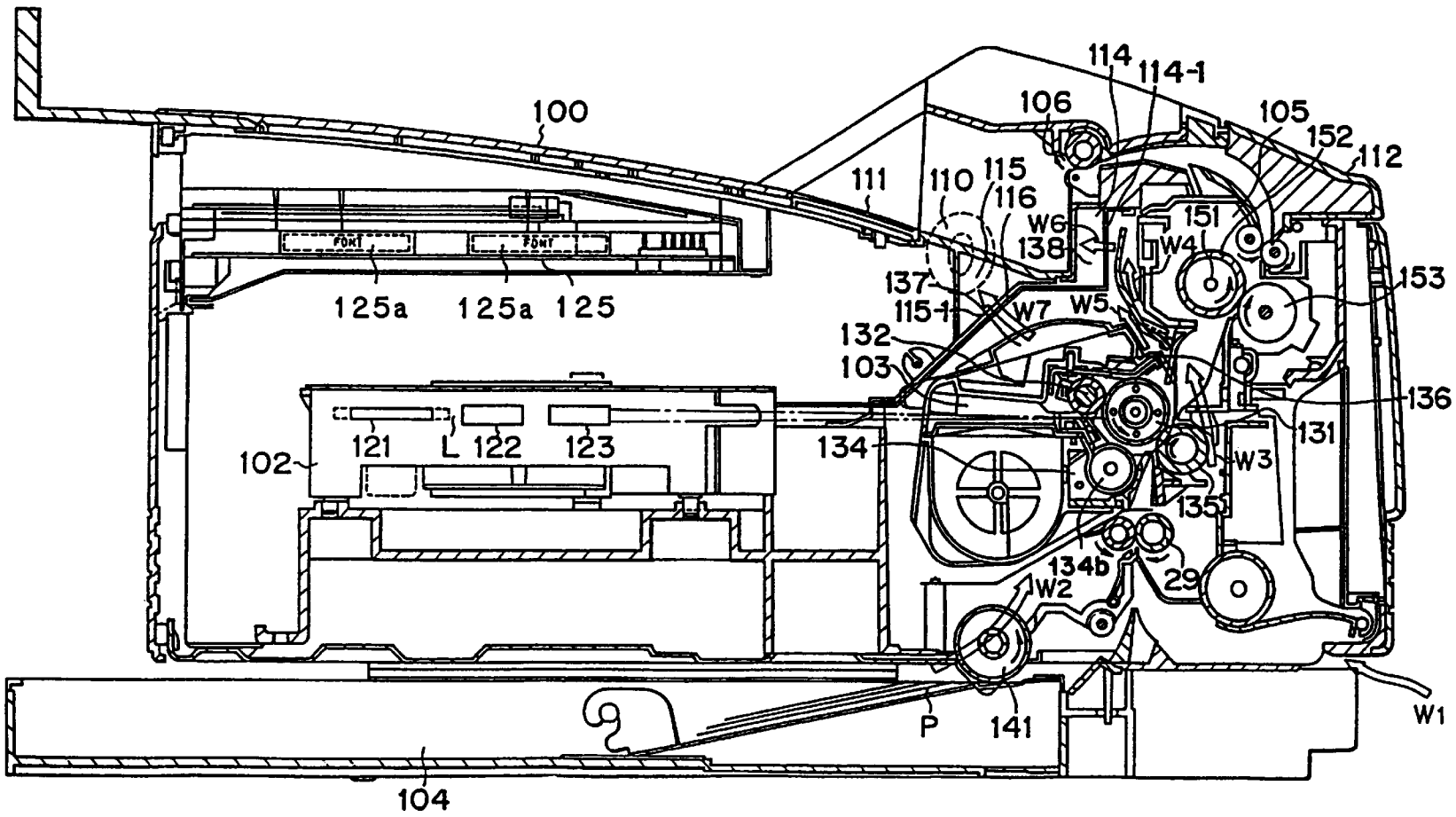
FIG. 12 is an elevational sectional view of a laser beam printer to which an embodiment of the present invention is applied.

In FIGS. 11 and 12, a laser beam L emitted from a laser unit (not shown) of a scanner unit 102 is deflected by a polygonal mirror 121 and then is focused on the photosensitive drum 131 (rotated in a direction shown by the arrow) through focusing lenses 122, 123.

A charger roller 132 for uniformly charging the photosensitive member 131*a* is disposed at an upstream side of an exposure position for the laser beam L. An electrostatic latent image formed on the photosensitive drum 131 by the laser beam L is visualized by the developing device 134 having the developing sleeve 134*b* to which the bias voltage is applied.

On the other hand, a transfer sheet P in a sheet supply cassette 104 is supplied by a sheet supply roller 141 and is fed between the photosensitive drum 131 and a transfer roller 135. The visualized image on the photosensitive drum 131 is transferred onto the transfer sheet P by the bias voltage of the transfer roller 135. The transfer sheet P to which the image was transferred passes through between a fixing roller 152 (having a heater 141) and a pressure roller 153 of a fixing device 105, where the visualized image is permanently fixed to the transfer sheet. Thereafter, the transfer sheet P is ejected onto an ejection tray 111. Incidentally, the residual toner remaining on the photosensitive drum 131 is removed by the cleaner 137 having the cleaning blade 136.

Incidentally, the above-mentioned photosensitive drum 131, charger roller 132, developing device 134 and cleaner 137 are contained within the process cartridge 103. Further, the reference numeral 125 denotes a font mounting portion on which fonts 125*a* are mounted.

In this way, by feeding the transfer sheet upwardly, it is possible to arrange the process elements closely, thus making the printer compact or small-sized.

Next, air flows generated in forming the image by the laser beam printer 100 within which the process cartridge 103 is mounted will be explained with reference to FIGS. 11 and 12.

In this embodiment, a fan 110 is disposed below an outlet 106 for the sheet P to be ejected and at an end of the printer 100. When the fan (for example, axial flow fan in this embodiment) 110 is rotated, the ambient cool air is introduced into the printer through clearances at the front unit 112, sheet supply roller 141 and the like (arrows $W_1$, $W_2$). The air flows $W_1$, $W_2$ pass through the vicinity of the transfer roller 135 (arrow $W_3$) to reach the cartridge 103. A part of this air flow passes by the lateral side of the fixing device 105 (arrow $W_4$) and then is discharged from the printer through an opening 114-1 (arrow $W_6$). Further, a part of the above-mentioned air flow passes through the vicinity of the photosensitive drum 131 and through the space S between the housing 139 of the cartridge 103 (particularly, housing portion positioned near a free end portion 137-1 of the cleaner 137) and the drum shutter 138 (arrow $W_5$) and then is discharged from the printer through an opening 115-1 (arrow $W_7$).

In this way, according to this embodiment, the air discharging fan 110 is disposed at ends of air flow passages 114, 115, and the air in the cartridge 103 is sucked into the printer mainly through the openings 114-1, 115-1 formed in a partition wall 116 for the air flow passages 114, 115 and then is discharged from the printer 100.

Figure 13:
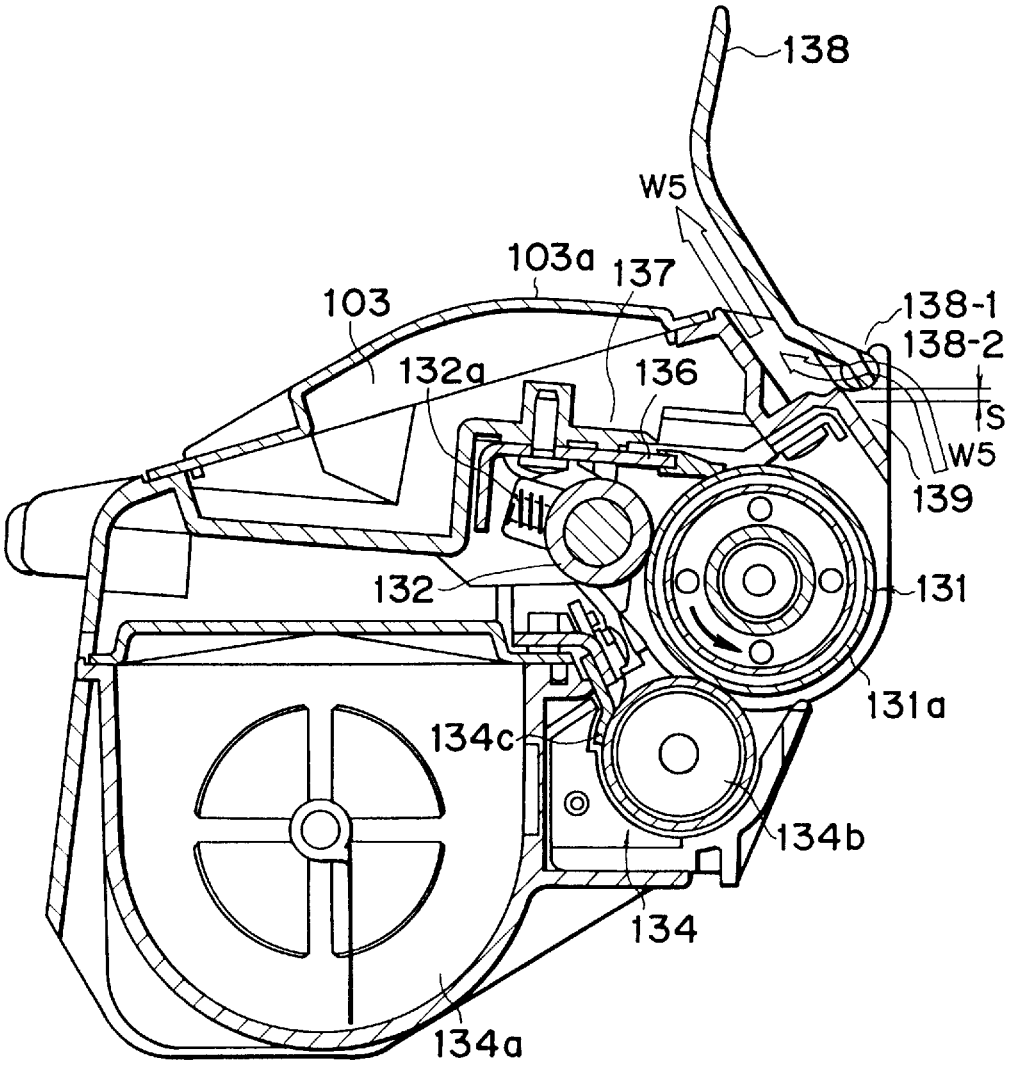
FIG. 13 is a cross-sectional view of a process cartridge to which a still further embodiment of the present invention is applied.

Next, further embodiments of the present invention will be explained with reference to FIGS. 13 to 15, among which FIG. 13 is a cross-sectional view of a process cartridge 103 to which the further embodiment of the present invention is applied.

In this embodiment, one or several cam-shaped ribs 138-5 eccentric from the pivot pins 138-1, 138-2 for the drum shutter 138 are arranged along the longitudinal direction of the shutter. According to this embodiment, when the drum shutter 138 is rotated, the rib 138-5 is abutted against the housing 138 of the cartridge, with the result that the drum shutter 138 is flexed to create the clearance S between shutter 138 and the housing 139 of the cartridge.

Figure 14:
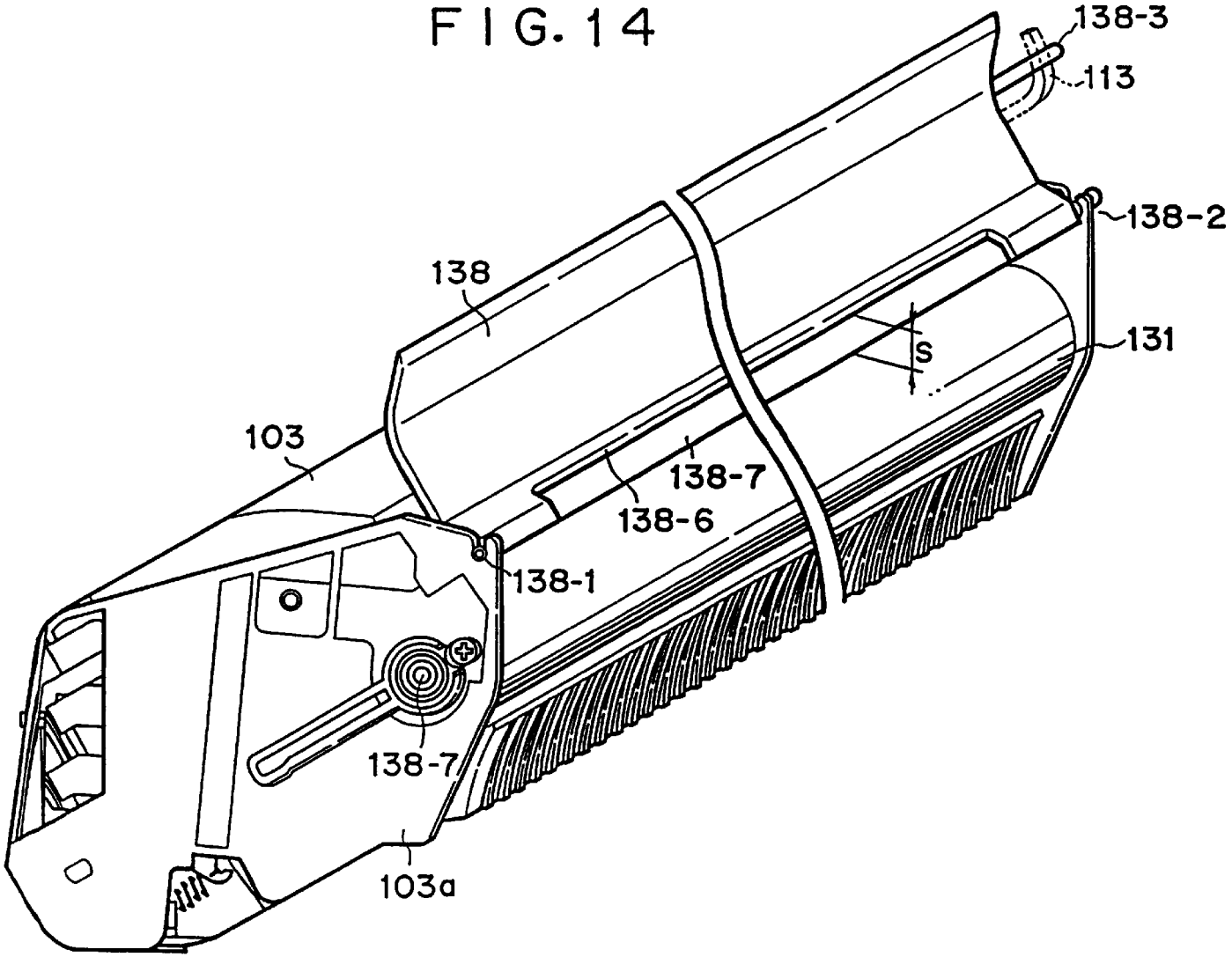
FIG. 14 is a perspective view of a process cartridge to which a further embodiment of the present invention is applied.

FIG. 14 is a perspective view of a process cartridge 103 according to a still further embodiment of the present invention, in which a central portion of the drum shutter 138 has a longitudinal cut-out or notched portion 138-6. According to this embodiment, the clearance S is created between the drum shutter 138 and the cartridge housing 139 by the notched portion 138-6.

Figure 15:
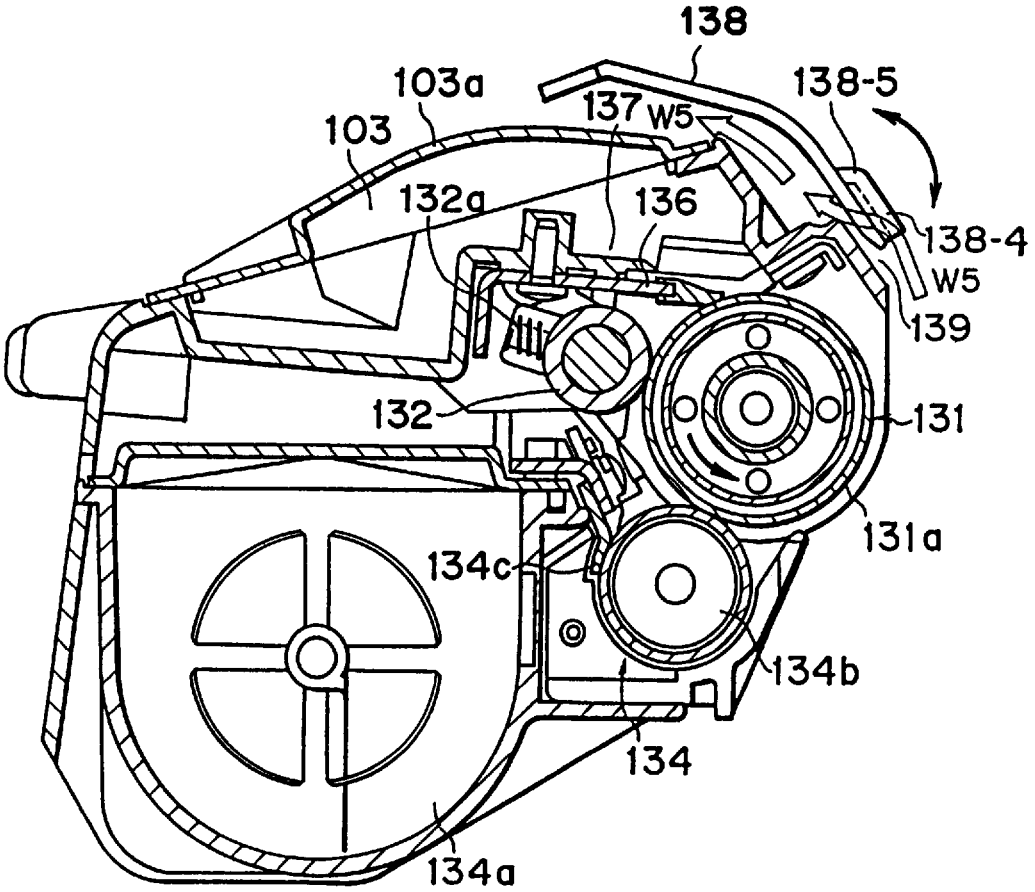
FIG. 15 is a cross-sectional view of a process cartridge to which a still further embodiment of the present invention is applied.

FIG. 15 shows a further embodiment of the present invention. In this embodiment, unlike to the above-mentioned embodiments wherein the drum shutter 138 is pivotable, the drum shutter 138 can be opened and closed by being slid by a slide mechanism (not shown) such as a link mechanism in the vicinity of the surface of the photosensitive drum 131. Also in this embodiment, a protruded member 138-7 may be formed on the front central portion of the drum shutter 138 or a notched portion 138-6 may be formed in the rear central portion of the shutter to create the clearance, so that the advantage same as those of the previous embodiments can be obtained.

Further embodiments will be explained with reference to FIGS. 16 to 19.

The embodiments which will be described hereinbelow show (1) an example that a shield member for preventing the entrance of air flow into predetermined areas is formed on the above-mentioned drum shutter, and (2) an example that a shield member for cooperating with the drum shutter to prevent the entrance of air flow into predetermined areas is formed on an image forming system. Incidentally, these embodiments will be described hereinbelow as examples that these are applied to the laser beam printer shown in FIG. 12.

Figure 16:
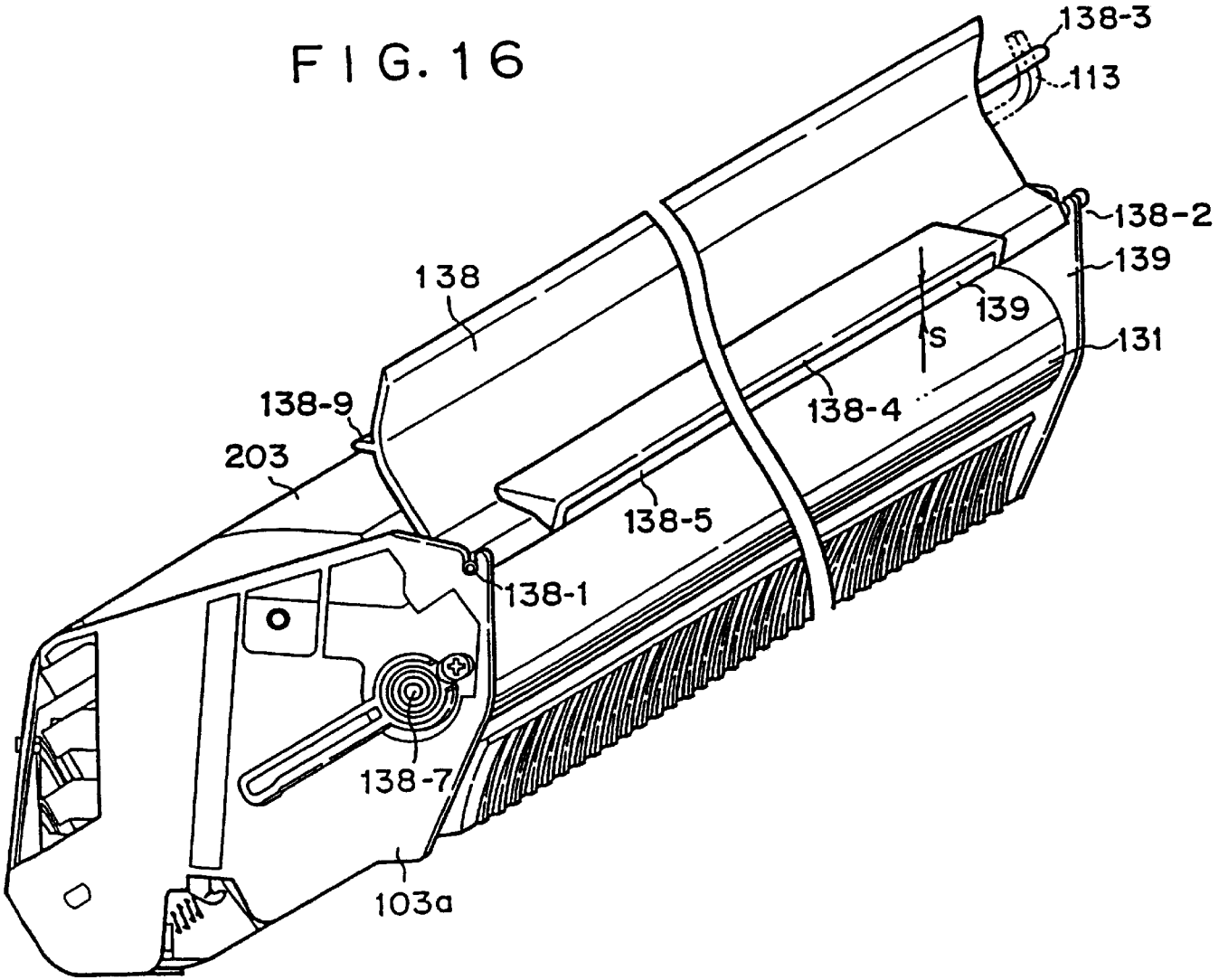
FIG. 16 is a perspective view of a process cartridge to whcih a further embodiment of the present invention is applied.
Figure 17:
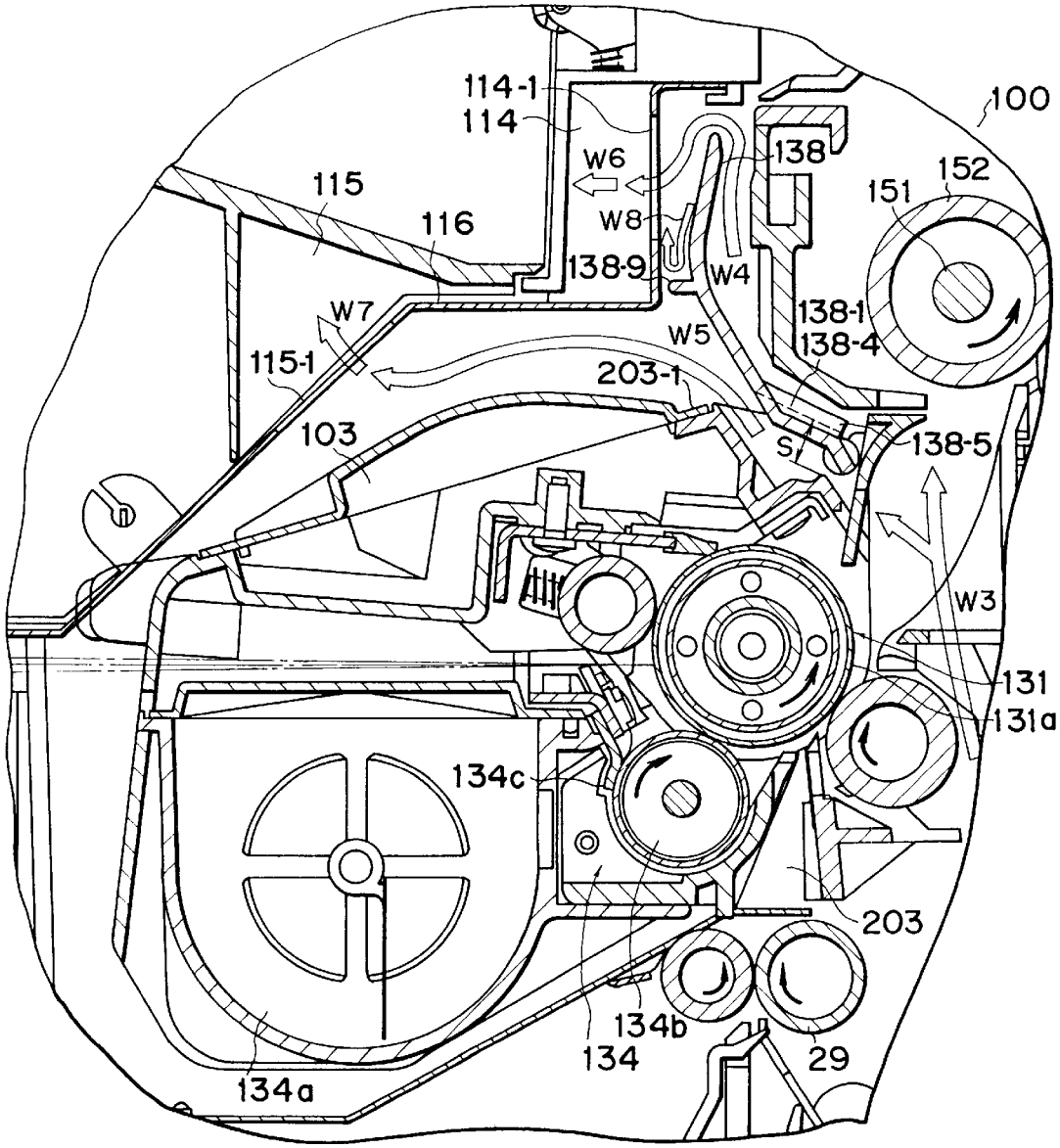
FIG. 17 is an elevational sectional view of a main portion of a laser beam printer to which another embodiment of the present invention is applied.

Now, FIG. 16 is a perspective view of a process cartridge 203 relating to the above example (1), and FIG. 17 is a partial elevational sectional view showing the air flows in forming the image by using the laser beam printer 100 within which the process cartridge 203 was mounted. Incidentally, FIGS. 18 and 19 are partial elevational sectional views showing the above example (2).

In the embodiment shown in FIGS. 16 and 17, a longitudinal rib 138-9 (a protruding amount (from the surface of the drum shutter) of which is about 5 mm) is formed on a back surface the drum shutter 138 (a surface opposite to the photosensitive drum 131 when the shutter is closed). When the cartridge 203 is mounted within the printer 100 and the drum shutter 138 is opened, the rib 138-9 is positioned to be abutted against or substantially abutted against the air discharging opening 114-1 of the printer 100. That is to say, the rib 138-9 is positioned so that a free end of the rib is situated in the proximity of the lower partition wall 116 for the opening 144-1. Thus, an air flow $W_4$ including hot air and passing through the vicinity of a fixing device 105 or the interior of the fixing device is blocked by the rib 138-9 (This condition is shown by the arrow $W_8$). Accordingly, the high temperature air flow is ejected out of the printer through the opening 114-1, without flowing toward an upper surface 203-1 of the housing of the cartridge 203 (air flow $W_6$).

According to this embodiment, it is possible to obtain air passages same as those as mentioned above. Thus, the constructural elements in the cartridge 203 (for example, photosensitive drum 131, toner and the like) can be prevented from being exposed to the high temperature air. Further, since the cool air always flows through the vicinity and interior of the cartridge 203, it is possible to further suppress the increase in temperature of these constructural elements.

Figure 18:
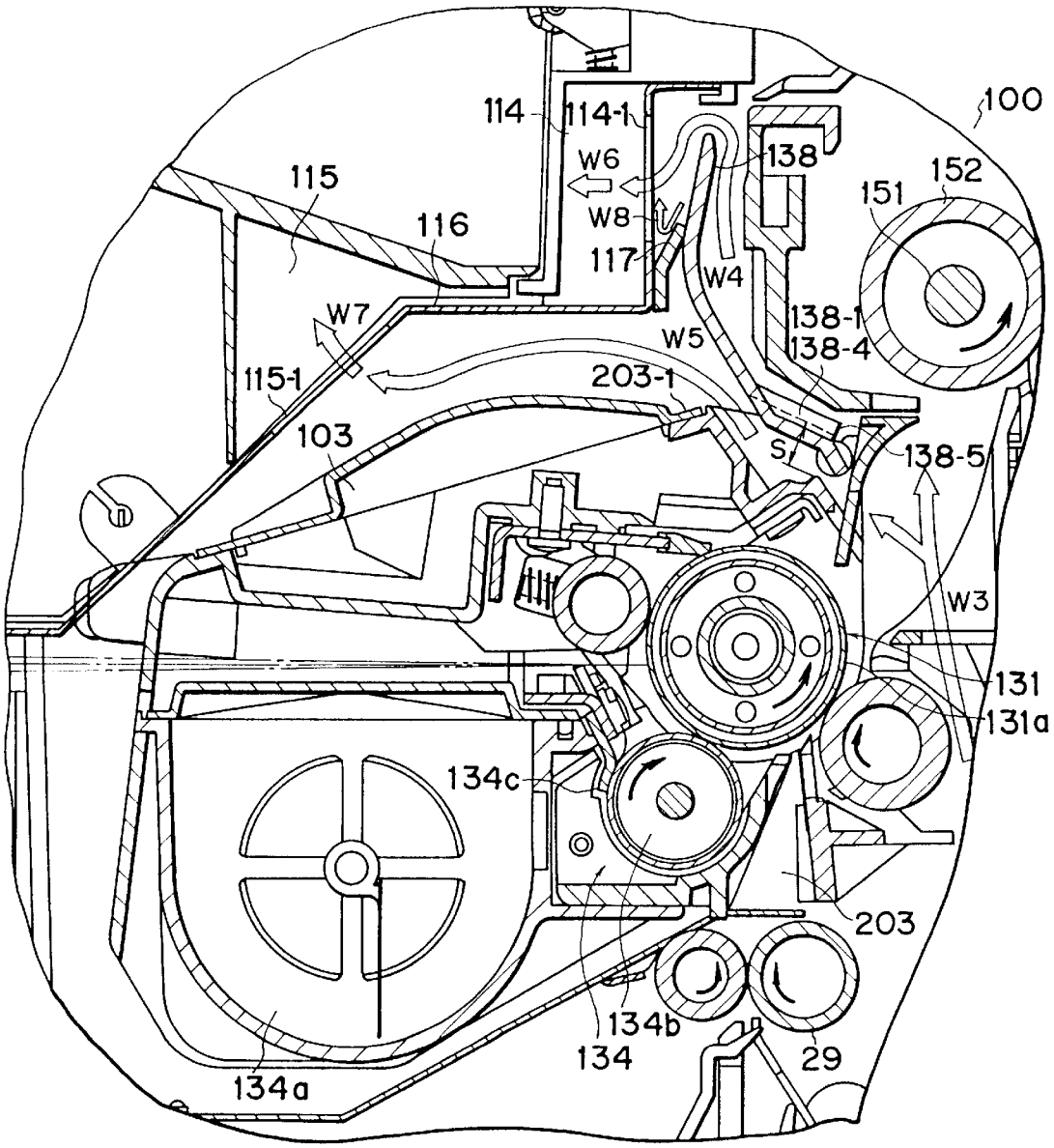
FIG. 18 is an elevational sectional view of a main portion of a laser beam printer to which a further embodiment of the present invention is applied.
Figure 19:
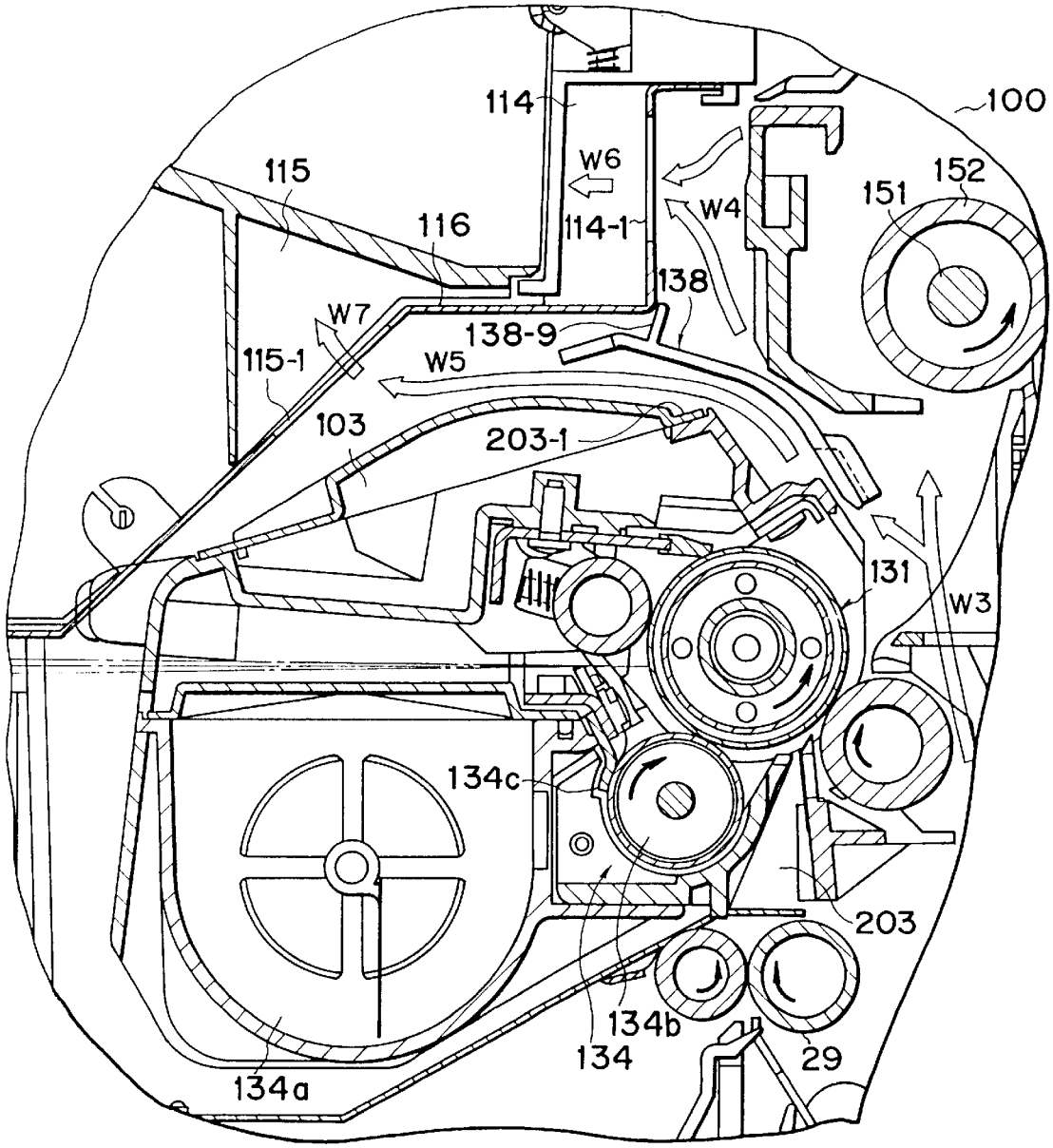
FIG. 19 is an elevational sectional view of a main portion of a laser beam printer to which a still further embodiment of the present invention is applied.

Next, in an embodiment shown in FIG. 18, a partition member 117 for abutting against the drum shutter 138 is secured to the lower partition wall 116 for the air discharging opening 114-1 of the printer. The partition member 117 has a width substantially the same as that of the drum shutter 138 and is slightly bent toward the drum shutter 138 so that it is apt to be abutted against the drum shutter 138. According to this embodiment, when the drum shutter 138 is rotated to reach the open position, the drum shutter is abutted against the partition member 117, thus surely directing the air flow $W_4$ to the opening 114-1. Incidentally, in this embodiment, the partition member 117 is made from plastic material to give it the elasticity.

In this case, when the partition member 117 is made from elastically deformable materials (for example, resin, rubber, foam materials or the like) or is formed to have the elasticity or flexibility, the excellent advantage can be obtained. In this way, it is possible to perform the pivotal movement of the drum shutter 138 smoothly, thus ensuring the predetermined air passages.

On the other hand, in an embodiment shown in FIG. 19, the drum shutter 138 is not rotated, but is slid in the vicinity of the surface of the photosensitive drum 131. Also in this case, the rib 138-9 may be formed on the back surface of the drum shutter 138 so that the rib can be abutted against the partition wall 116 for the air discharging opening 114-1 or be positioned in the proximity of the partition wall, thus obtaining the same advantage as the above one.

In this way, according to the embodiments shown in FIGS. 17 to 19, since the air flows including the hot air are prevented from directing to the vicinity of the cartridge, it is possible to further suppress the increase in temperature of the cartridge. Further, according to the embodiments shown in FIGS. 16 and 17, since the protruded portion 138-4 is positioned in the vicinity of or abutted against the cartridge housing 139 when the drum shutter 138 is closed, the photosensitive drum 131 is prevented from being exposed to the ambient light or is hard to be damaged by foreign matters or the operator's finger.

Next, other embodiments of the present invention will be explained with reference to FIGS. 20 to 25. Incidentally, in embodiments which will be described hereinbelow, an air intake opening is formed on a side wall of the laser beam printer 100 at its upper part, so that the ambient cool air can be introduced into the printer mainly from upper and lower portions thereof, thus further enhancing the cooling efficiency for the process cartridge.

Figure 20:
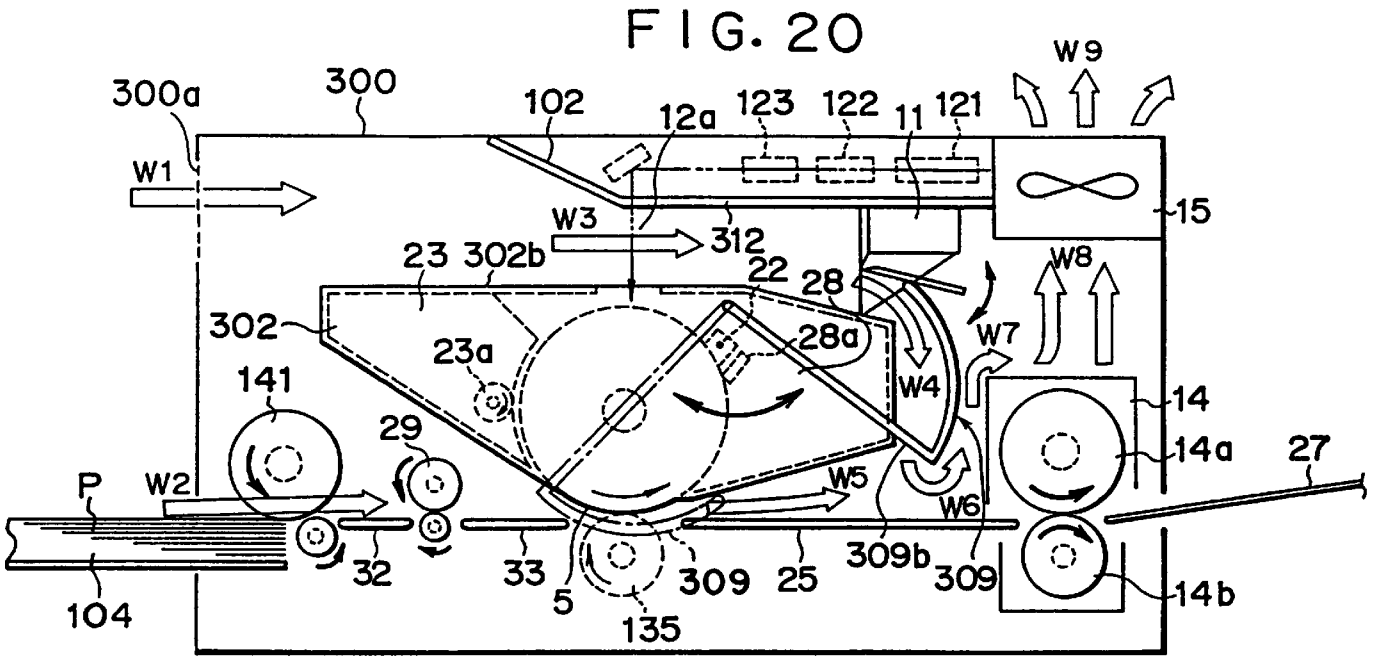
FIG. 20 is an elevational sectional view of a laser beam printer to which a further embodiment of the present invention is applied.
Figure 21B:
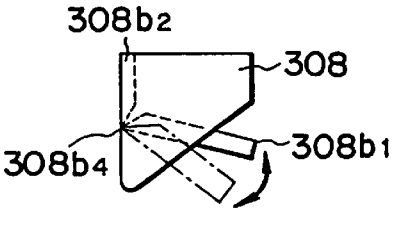
FIG. 21B is an end view of the regulating member of FIG. 21A.
Figure 21A:
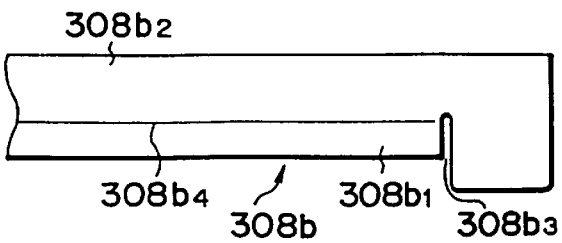
FIG. 21A is a plan view of a regulating member.
Figure 22A:
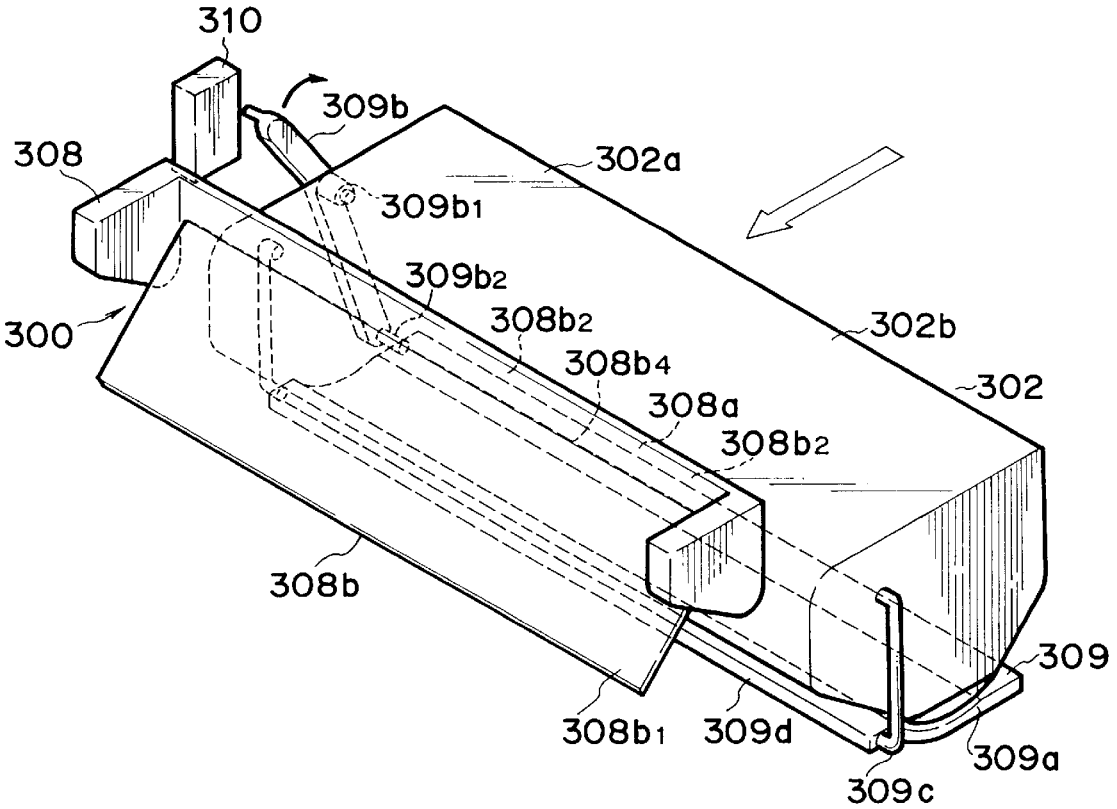
FIG. 22A is a perspective view showing a relation between a process cartridge and a regulating member of a machine to whcih the other embodiment of the present invention is applied, in a condition that a drum protection member is closed.
Figure 22B:
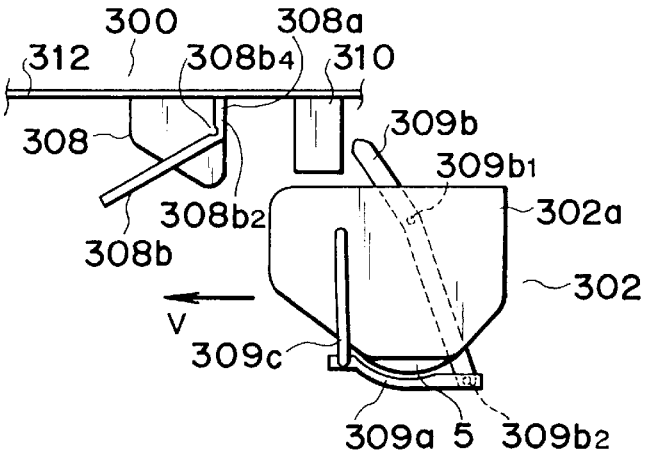
FIG. 22B is an end view showing a relation between the process cartridge of FIG. 22A and the regulating member of the machine.
Figure 23A:
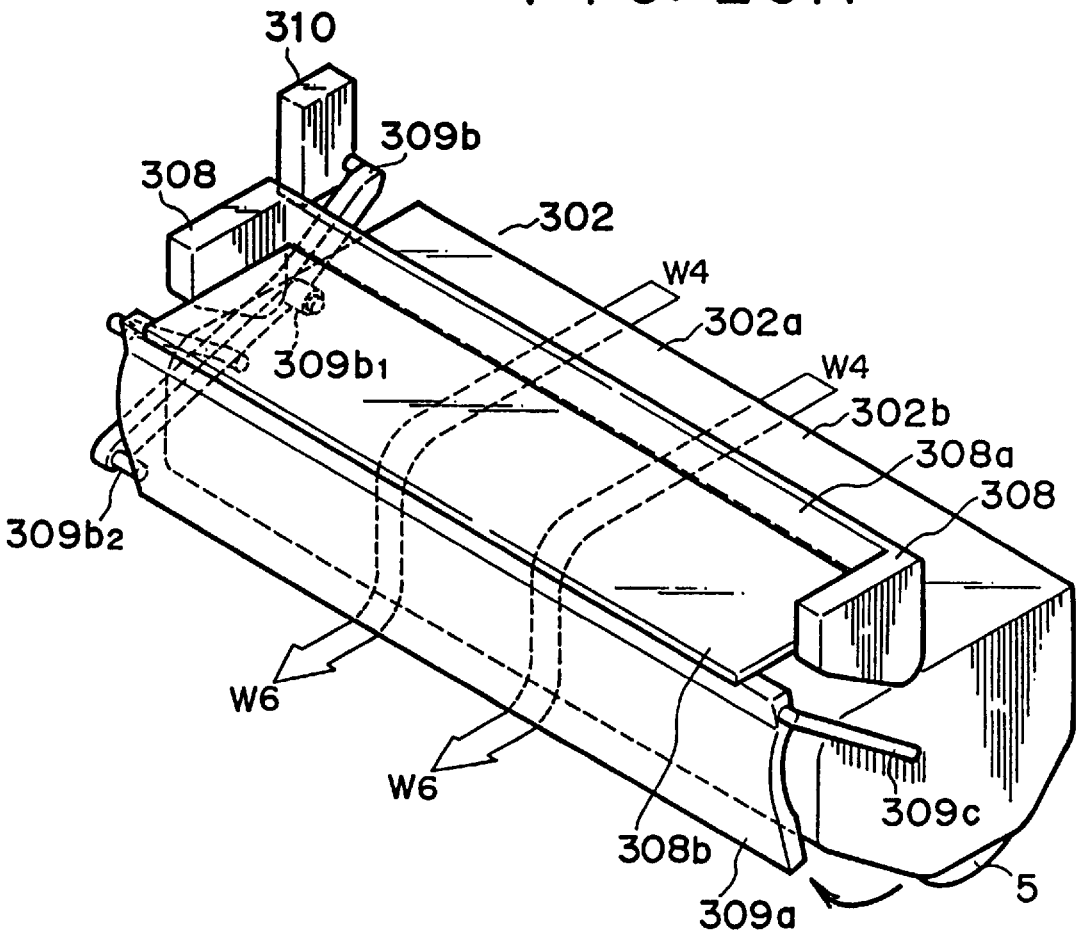
FIG. 23A is a perspective view showing a condition that the drum protection member is opened.
Figure 23B:
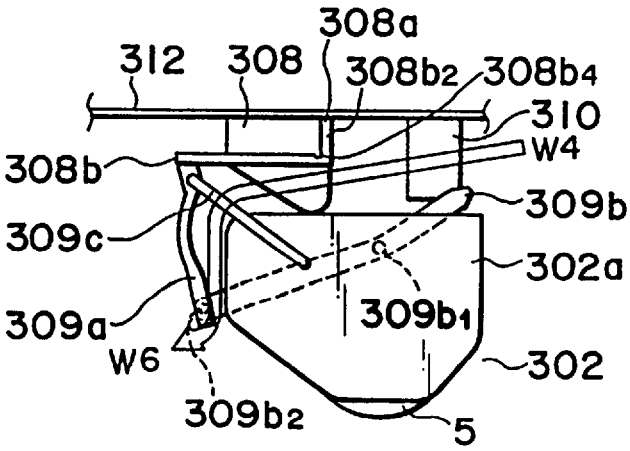
FIG. 23B is an end view showing the condition that the drum protection member is opened.
Figure 24:
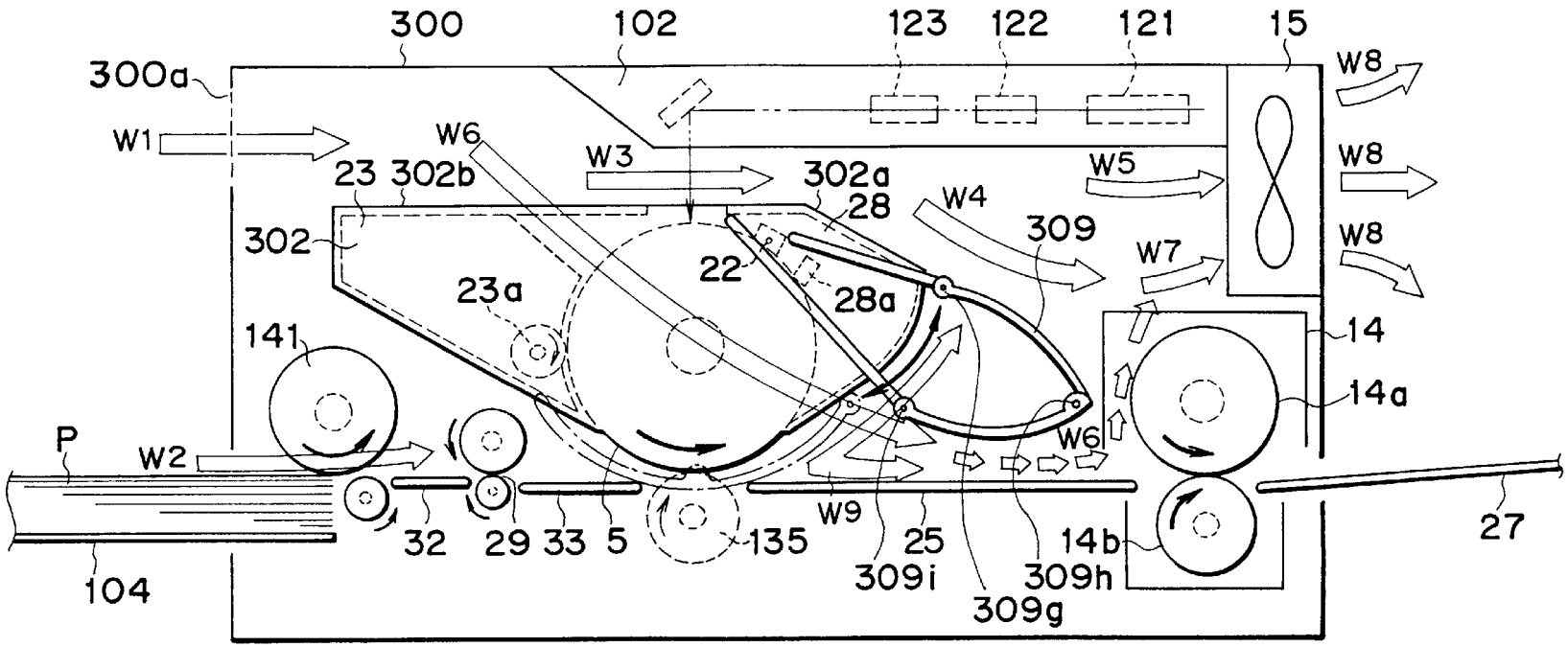
FIG. 24 is an elevational sectional view of a laser beam printer to which a further embodiment of the present invention.
Figure 25:
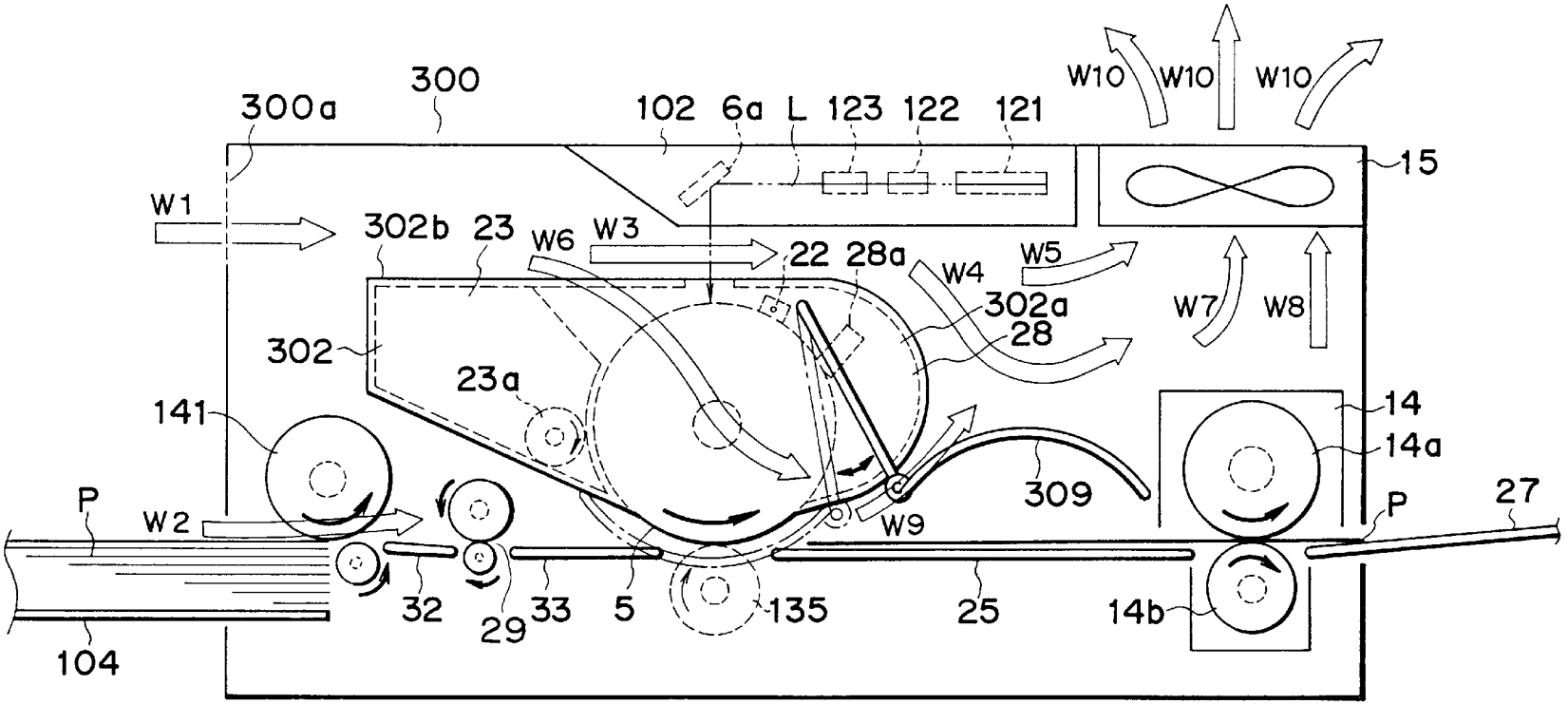
FIG. 25 is an elevational sectional view of a laser beam printer to which the other embodiment of the present invention.

Incidentally, constructural elements same as those of the previous embodiments are designated by the same reference numerals, and the detailed explanation thereof will be omitted. FIG. 20 is an elevational sectional view of the laser beam printer, FIG. 21A is a longitudinal partial plan view of a regulating member for maintaining a protection member of the cartridge in an open condition, FIG. 21B is an end view of the regulating member, FIGS. 22A and 23A are perspective views of an opening/closing mechanism for the protection member of the cartridge, and FIGS. 22B and 23B are end views of such mechanism. Incidentally, FIGS. 24 and 25 are elevational sectional views of laser beam printers to which the other embodiments of the present invention are applied.

When a process cartridge 302 is inserted into a laser beam printer 300 (from a direction shown by the arrow V), a protection member 309 for protecting an image bearing member 5 of the process cartridge 302 from light, external force, smudge and the like is shifted from a protecting position (closed position) to a retard position (open position). Incidentally, an opening/closing mechanism for the protection member 309 will be explained later. In this case, the process cartridge 302 can be correctly mounted in a predetermined position, because an upper surface 302*b* of the cartridge is abutted against a position regulating member 308 disposed at an upper part of a cartridge mounting position, thus regulating a position of the cartridge in an upward direction. Further, in this case, a rear end 309*d* of the protection member 309 is abutted against a flow rectifying plate 308*b* pivotally provided on the position regulating member 308 along the transversal direction of the printer to lift this flow rectifying plate 308*b,* thus maintaining this plate in a slightly downwardly inclined position.

Incidentally, the flow rectifying plate 308*b* is made from flexible materail such as resin and the like and has an attachment portion 308*b*2 and a flow rectifying portion 308*b*1 pivotable with respect to the attachment portion 308*b*2. Further, the flow rectifying portion 308*b*1 is obliquely formed with respect to the attachment portion 308*b*2 and is apt to be pivoted due to the presence of notches 308*b*3.

In this condition, when a copy button (not shown) is turned ON, a fan 15 is rotated to suck the air through an air introduction opening 300*a* formed in a side wall of the printer 300 at its upper part and from a sheet supply portion, thus generating air flows ($W_1$–$W_9$) flowing around the process cartridge 302 and directing toward the fan 15. Now, the air flow $W_3$ flowing along the upper surface of the process cartridge 302 impinges against and blocked by a wall 305*b* of the position regulating member 308, with the result that this air flow passes through a clearance between a housing 302*a* of the process cartridge 302 and an inner surface of the protection member 309 (air flow $W_4$). This air flow $W_4$ impinges against a sheet conveying surface (guide 25) and changes its flow direction between the sheet conveying surface 25 and the protection member 309 to be directed upwardly (air flow $W_6$), and then flows toward the fan 15 as the air flows $W_7$, $W_8$ toward the fan 15 from which they are ejected out of the printer (air flow $W_9$).

Next, the movements of the protection member 309 and the position regulating member 308 in mounting the process cartridge 302 within the printer 300 will be explained with reference to FIGS. 22A, 22B and 23A, 23B.

FIGS. 22A and 22B show a condition that the process cartridge 302 starts to be mounted on a predetermined position within the printer 300. From this condition, when the housing 302*a* of the process cartridge 302 is inserted toward the direction V, first of all, a cover moving link 309*b* for opening a cover 309*a* of the protection member 309 is abutted against a protrusion 310 of the printer. When the housing 302*a* of the process cartridge is further inserted, the cover moving link 309*b* is rotated around a pivot pin 309*b*1, with the result that the cover 309*a* of the protection member attached to a pivot pin 309*b*2 positioned on the other end of the link 309*b* (opposite to an end which is abutted against the protrusion 310 with respect to the pivot pin 309*b*1) is gradually opened while being guided by a movable link 309*c*. When the housing 302*a* of the process cartridge is completely inserted, the cover 309*a* of the protection member is abutted against the flow rectifying plate 308*b* of the position regulating member 308 as mentioned above, thus rotating the flow rectifying portion 308*b*1 around a pivot portion (reduced thickness portion) 308*b*4 of the flow rectifying plate.

In the condition that the housing 302*a* of the process cartridge 302 is completely mounted within the printer 300 (FIGS. 20, 23A and 23B), the air flows in the printer 300 as air flows $W_1$–$W_9$. Particularly, as shown by the air flow W the air flow passing between the housing 302*a* of the process cartridge 302 and a plate 312 of the printer impinges against a wall 308*a* (attachment portion 308*b*2) of the position regulating member 308 for the process cartridge 302. Then, this air flow passes through between the housing 302*a* and the flow rectifying plate 308*b* and between the housing 302*a* and the cover 309*a* of the protection member. Thus, the housing 302*a* of the process cartridge 302 is hard to be receive the heat from the fixing device 14, thus suppressing the increase in the temperature in the cartridge 302. Incidentally, in the illustrated embodiment, while the clearance between the housing 302*a* and the cover 309*a* of the protection member was selected to have a value of about 5 mm–10 mm, the clearance is not limited to this value.

A further embodiment of the present invention is shown in FIG. 24. In this embodiment, a protection member 309 is divided into several segments hinged together at points 309*g*, 309*h* and 309*i*. When the projection member is opened, it is folded into two at the hinge 309*h* to face their inner surface (facing the image bearing member) to each other. Now, when the fan 15 is rotated, the air flow $W_1$ sucked from the air introduction opening 300*a* flows around the process cartridge 302 (air flow $W_3$) to reach the protection member 309 and then flows toward the fan 15 (air flow $W_4$). In this case, air flows $W_6$ flowing along the end surfaces of the process cartridge are restricted by the protection member 309 to lose their powers. These air flows become a part of the natural convection as shown by the arrows $W_6$ by the convection of heat from the fixing device 14, and are ejected by the fan 15 out of the printer as shown by the arrows $W_7$, $W_8$.

Therefore, according to the present invention, it is possible to prevent the heat generated by the fixing device 14 from flowing toward the cartridge mounting direction. Incidentally, also in this embodiment, the air flow $W_2$ taken from the sheet supply portion passes through the proximity of the photosensitive member 5, and a part of this air flow passes through between the housing 302*a* and the protection member 309 and is sucked by the fan 15 (air flow $W_9$).

The other embodiment of the present invention is shown in FIG. 25. In this embodiment, ambient air taken through the air introduction opening 300*a* by the rotation of the fan 15 passes around the process cartridge 302 and is sucked into the fan 15 (air flows $W_1$, $W_3$, $W_4$, $W_5$, $W_7$ and $W_8$). According to this embodiment, the air flowing along the upper surface 302*a* of the process cartridge is directed to the protection member 309 as shown by the arrow $W_4$ and then is ejected out of the printer. On the other hand, the air flows $W_6$ passing along the end surfaces of the process cartridge 302 are blocked by the protection member 309 not to enter below the protection member 309. Further, according to this embodiment, the ambient air ($W_2$) taken through the air introduction opening 300*a* passes through the proximity of the photosensitive member 5 and then passes mainly between the housing 302*a* and the protection member 309 not to progress toward the fixing device 14, because it is blocked by the protection member 309 so that it is not influenced upon the fan 15. Thus, it is possible to prevent the distortion of the image formed on the sheet P (before fixing) due to the air flow.

Incidentally, in the above embodiments, while an example that a heat fixing device is used as the fixing device was explained, the present invention is not limited to this example. For example, a pressure fixing device may be used. Further, other than the heat fixing device, although motors, exposure lamp and the like also generate the heat in the image forming system, the present invention is also effective to the generation of heat from such elements.

Further, the clearance (distance) between the housing of the process cartridge and the cover can be appropriately selected in accordance with the designs of the process cartridge and the image forming system; however, such clearance may be about 2 mm–50 mm, and preferably 3 mm–40 mm, and most preferably 5 mm–20 mm. If the clearance is smaller than about 2 mm, the sufficient cooling ability cannot sometimes be obtained (However, even if the clearance is about 1 mm, some cooling ability can be obtained in comparison with the case where there is no clearance); whereas, if the clearance is greater than about 50 mm, the image forming system will become large-sized.

Incidentally, the above-mentioned process cartridge incorporates therein an image bearing member (for example, electrophotographic photosensitive member and the like), and at least one of a charger means, developing means and cleaning means (action means) as a unit which can removably mounted within an image forming system. More specifically, the process cartridge incorporates therein a charger means, developing means or cleaning means, and an electrophotographic photosensitive member as a unit which can be removably mounted within an image forming system (for example, a copying machine, laser beam printer or the like); or incorporates therein at least one of a charger means, developing means and cleaning means, and an electrophotographic photosensitive member as a unit which can be removably mounted within an image forming system (for example, a copying machine, laser beam printer or the like); or incorporates therein at least a developing means and an electrophotographic photosensitive member as a unit which can be removably mounted within an image forming system (for example, a copying machine, laser beam printer or the like).

As mentioned above, according to the present invention, it is possible to provide a process cartridge and an image forming system which can remarkably enhance the cooling ability for the process cartridge by air flows.

What is claimed is:

1. A process cartridge detachably mountable to an image forming system, said process cartridge comprising:

an electrophotographic photosensitive drum;

processing means for acting on said electrophotographic photosensitive drum;

a frame for supporting said electrophotographic photosensitive drum and said processing means; and a cover that is rockable about one end portion in a short-side direction thereof between a closed protecting position to protect said electrophotographic photosensitive drum and an opened retracted position retracted from the protected position, wherein said cover has a protruded portion provided on an inner surface of said cover along one long-side edge of said cover about which said cover is rockable to form a clearance between said protruded portion and said frame when said process cartridge is mounted to a main body of the image forming system and said cover is positioned in the retracted position, and wherein the clearance allows an air flow between said protruded portion and said frame when said cover is in the retracted position.

2. A process cartridge according to claim 1, wherein the clearance between said frame and said cover ranges from 2 mm to 5 mm.

3. A process cartridge according to claim 2, wherein said frame comprises styrene and said cover comprises polycarbonate.

4. A process cartridge according to claim 1, wherein said cover covers a transfer area of said electrophotographic photosensitive drum when positioned in the protecting position.

5. A process cartridge according to claim 1, wherein said cover is provided at both ends with a pair of pins, each of said pair of pins having one end pivotally connected to said frame and another end secured to said cover.

6. A process cartridge according to claim 1, wherein said frame has a transfer opening for permitting the transferring of a developed image on said electrophotographic photosensitive drum onto a recording medium, and said cover covers said transfer opening when positioned in the protecting position.

7. A process cartridge according to claim 1, wherein said process cartridge incorporates therein charger means, developing means or cleaning means as said processing means, and said electrophotographic photosensitive drum as a unit which can be detachably mounted within said image forming system.

8. A process cartridge according to claim 1, wherein said process cartridge incorporates therein at least one of charger means, developing means or cleaning means as said processing means, and said electrophotographic photosensitive drum as a unit which can be detachably mounted within said image forming system.

9. A process cartridge according to claim 1, wherein said process cartridge incorporates therein at least developing means as said processing means, and said electrophotographic photosensitive drum as a unit which can be detachably mounted within said image forming system.

10. A process cartridge according to claim 1, wherein said cover is shifted between the protecting position and the retracted position about a shaft provided along said electrophotographic photosensitive drum, and wherein said cover is protruded upwardly beyond an upper surface of said frame when in the retracted position.

11. A process cartridge according to claim 10, wherein said protruded portion is provided along said electrophotographic photosensitive drum.

12. A process cartridge according to claim 11, wherein said protruded portion is provided on said cover at a side of said shaft in a short direction thereof.

13. A process cartridge mountable onto a main body of an image forming system, said process cartridge comprising:

an image bearing member;

processing means for acting on said image bearing member; and a protection cover movable between a protecting position for protecting said image bearing member and a retracted position retracted from the protecting position, wherein an upper periphery of said protection cover assumes a level at least as high as an upper surface of said process cartridge in the retracted position for forming a gap to allow an air flow between said protection cover and said process cartridge, wherein an outer surface of said protection cover is provided with a longitudinal projection which blocks an air flow directed to said process cartridge when said protection cover is positioned in the retracted position.

14. An image forming system to which a process cartridge is removably mounted for forming an image on a recording medium, said image forming system comprising:

mount means for removably mounting a process cartridge, said process cartridge comprising an electrophotographic photosensitive drum, processing means for acting on said electrophotographic photosensitive drum, a frame for supporting said electrophotographic photosensitive drum and said processing means, and a cover that is rockable about one end portion in a short-side direction thereof between a closed protecting position to protect said electrophotographic photosensitive drum and an opened retracted position retracted from the protected position, wherein said cover has a protruded portion provided on an inner surface of said cover along one long-side edge of said cover about which said cover is rockable to form a clearance between said protruded portion and said frame when said process cartridge is mounted to a main body of the image forming system and said cover is positioned in the retracted position, and wherein the clearance allows an air flow between said protruded portion and said frame when said cover is in the retracted position;

air flow generating means for generating an air flow flowing through the clearance when said cover assumes the retracted position;

transfer means for transferring a developed image formed on said electrophotographic photosensitive drum onto a recording medium; and conveying means for conveying the recording medium.

15. A process cartridge removably mounted to an image forming system, said process cartridge comprising:

an electrophotographic photosensitive drum;

a charge roller for charging said electrophotographic photosensitive drum;

a developing roller for developing a latent image formed on said electrophotographic photosensitive drum;

a cleaning blade for removing a developing agent left on said electrophotographic photosensitive drum;

a frame for supporting said electrophotographic photosensitive drum, said charge roller, said developing roller, and said cleaning blade; and a cover that is rockable about one end portion in a short-side direction thereof between a closed protecting position to protect said electrophotographic photosensitive drum and an opened retracted position retracted from the protected position, wherein said cover has a protruded portion provided on an inner surface of said cover alone one long-side edge of said cover about which said cover is rockable to form a clearance between said protruded portion and said frame when said process cartridge is mounted to a main body of the image forming system and said cover is positioned in the retracted position, and wherein the clearance allows an air flow between said protruded portion and said frame when said cover is in the retracted position.

16. A process cartridge according to claim 15, wherein the clearance between said frame and said cover is about 2 mm to 5 mm.

17. A process cartridge according to claim 15 or 16, wherein said frame comprises styrene, and said cover comprises polycarbonate.

18. A process cartridge according to claim 15, wherein said cover is shifted between the protecting position and the retracted position about a shaft provided along said electrophotographic photosensitive drum, and wherein said cover is protruded upwardly beyond an upper surface of said frame when in the retracted position.

19. A process cartridge according to claim 18, wherein said protruded portion is provided along said electrophotographic photosensitive drum.

20. A process cartridge according to claim 19, wherein said protruded portion is provided on said cover at a side of said shaft in a short direction thereof.

21. A process cartridge according to claim 15, wherein said frame has a transfer opening for permitting the transferring of a developed image on said electrophotographic photosensitive drum onto a recording medium, and said cover covers said transfer opening when positioned in the protecting position.

22. An image forming system to which a process cartridge is removably mounted for forming an image onto a recording medium, said image forming system comprising:

mount means for removably mounting a process cartridge to said image forming system, said process cartridge comprising an electrophotographic photosensitive drum; a charge roller for charging said electrophotographic photosensitive drum; a developing roller for developing a latent image formed on said electrophotographic photosensitive drum; a cleaning blade for removing a developing agent left on said electrophotographic photosensitive drum; a frame for supporting said electrophotographic photosensitive drum, said charge roller, said developing roller, and said cleaning blade; and a cover that is rockable about one end portion in a short-side direction thereof between a closed protecting position to protect said electrophotographic photosensitive drum and an opened retracted position retracted from the protected position, wherein said cover has a protruded portion provided on an inner surface of said cover along one long-side edge of said cover about which said cover is rockable to form a clearance between said protruded portion and said frame when said process cartridge is mounted to a main body of the image forming system and said cover is positioned in the retracted position, and wherein the clearance allows an air flow between said protruded portion and said frame when said cover is in the retracted position;

an air fan for generating an air flow flowing through the clearance formed between said frame and the protruded portion when said cover assumes the retracted position;

a transfer roller for transferring a developed image formed on said electrophotographic photosensitive drum onto the recording medium; and conveying means for conveying the recording medium.

23. A process cartridge detachably mountable to an image forming system, said process cartridge comprising:

an electrophotographic photosensitive drum;

a processing unit acting onto said electrophotographic photosensitive drum, said processing unit including a charge member for charging said electrophotographic photosensitive drum, a developing roller rotating for supplying a toner to said electrophotographic photosensitive drum to thereby develop a latent image formed thereon, and a cleaning blade for removing the toner remaining on said electrophotographic photosensitive drum;

a frame for supporting said electrophotographic photosensitive drum and said processing unit; and a cover shiftable between a protecting position where said electrophotographic photosensitive drum is protected and a retracted position where said cover is retracted from said protecting position, said cover being spaced apart from said frame at least in said retracted position to create a clearance forming an air flow passage between said cover and said frame, wherein said cover is provided at an inner surface with a protruded portion protruding outwardly when said cover is opened, to create a clearance between said frame and said cover when said cover is positioned in said retracted position.

24. A process cartridge according to claim 23, wherein said protruded portion is provided at a side portion where said cover is pivoted along a longitudinal direction thereof.

25. A process cartridge according to claim 23 or 24, wherein said protruded portion is provided in a central portion of said cover in the longitudinal direction thereof.

26. A process cartridge removably mounted to an image forming system, said process cartridge comprising:

an electrophotographic photosensitive drum;

a charging roller disposed in contact with said electrophotographic photosensitive drum;

a latent image developing roller disposed adjacent to said electrophotographic photosensitive drum;

a developing agent cleaning blade disposed adjacent to said electrophotographic photosensitive drum;

a frame in which said electrophotographic photosensitive drum, said charging roller, said developing roller, and said cleaning blade are disposed; and a cover that is rockable about a shaft provided along one end portion in a short-side direction thereof and along said electrophotographic photosensitive drum between a closed protecting position to protect said electrophotographic photosensitive drum and an opened retracted position retracted from the protected position, wherein said cover has a protruded portion provided on an inner surface of said cover along one long-side edge of said cover about which said cover is rockable to form a clearance between said protruded portion and said frame when said process cartridge is mounted to a main body of the image forming system and said cover is positioned in the retracted position, wherein the clearance allows an air flow between said protruded portion and said frame when said cover is in the retracted position, and wherein said protruded portion is protruded upwardly beyond an upper surface of said frame when said cover is positioned in the retracted position.

* * * * *

UNITED STATES PATENT AND TRADEMARK OFFICE

CERTIFICATE OF CORRECTION

PATENT NO. : 5,878,304

DATED : March 2, 1999

INVENTOR(S) : KAZUSHI WATANABE, ET AL.

It is certified that error appears in the above-identified patent and that said Letters Patent is hereby corrected as shown below:

COLUMN 3
Line 5, "whcih" should read --which--.
Line 16, after "tion" insert --is applied--.
Line 19, after "tion" insert --is applied--.

COLUMN 10
Line 25, "to" should be deleted.

COLUMN 16
Line 62, "alone" should read --along--.

COLUMN 18
Line 61, "protruded portion" should read --cover--.

Signed and Sealed this

Seventh Day of September, 1999

*Attest:*

Q. TODD DICKINSON

*Attesting Officer*

*Acting Commissioner of Patents and Trademarks*